US005909206A

United States Patent [19]

Yokota et al.

[11] Patent Number: 5,909,206

[45] Date of Patent: Jun. 1, 1999

[54] DISPLAY CONTROL DEVICE

[75] Inventors: Yoshikazu Yokota; Gorou Sakamaki; Kunihiko Tani, all of Kodaira, Japan

[73] Assignee: Hitachi, Ltd., Tokyo, Japan

[21] Appl. No.: 08/990,650

[22] Filed: Dec. 15, 1997

Related U.S. Application Data

[62] Division of application No. 08/327,912, Oct. 24, 1994, Pat. No. 5,757,353.

[30] Foreign Application Priority Data

Dec. 7, 1993 [JP] Japan ..... 5-339964
Apr. 7, 1994 [JP] Japan ..... 6-095645

[51] Int. Cl.[6] ..... G09G 3/36

[52] U.S. Cl. ..... 345/98; 345/99; 345/213; 345/55

[58] Field of Search ..... 345/87, 88, 89, 345/98, 99, 100, 507, 515, 193, 196, 513, 197, 516, 517, 55, 212, 213

[56] References Cited

U.S. PATENT DOCUMENTS 5,153,574 10/1992 Kondo ..... 345/186
5,757,353 5/1998 Yokota et al. ..... 345/123

*Primary Examiner*—Xiao Wu
*Attorney, Agent, or Firm*—Fay, Sharpe, Beall, Fagan, Minnich & McKee

[57] ABSTRACT

CPU writes display character codes corresponding to a liquid crystal display position to display RAM to cause any desired character to be read from character generator ROM and to be displayed. There are provided a scroll display line designation register for designating a desired display line to be scrolled and a scroll dot quantity register for designating the scroll quantity in pixels. A scroll register supplies, to a segment shift register, character data which is delayed by the designated number of dots with respect to the character data on the designated display line and causes the display line to be displayed.

16 Claims, 18 Drawing Sheets

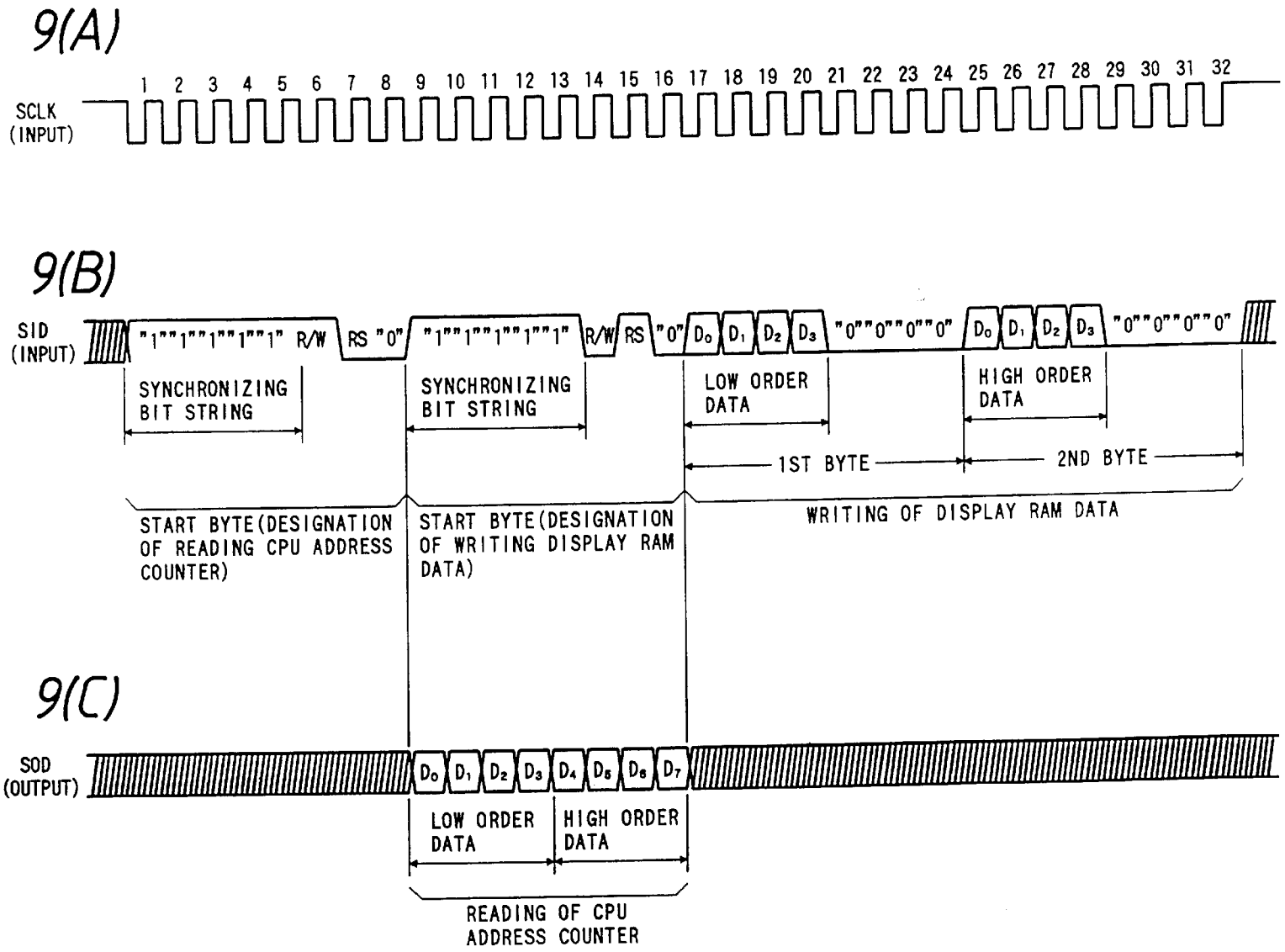
FIG. 9(A)
SCLK (INPUT)
1 2 3 4 5 6 7 8 9 10 11 12 13 14 15 16 17 18 19 20 21 22 23 24 25 26 27 28 29 30 31 32
FIG. 9(B)
SID (INPUT)
"1""1""1""1""1""1" R/W RS "0" "1""1""1""1""1""1" R/W RS "0" D0 D1 D2 D3 "0""0""0""0" D0 D1 D2 D3 "0""0""0""0"
SYNCHRONIZING BIT STRING
SYNCHRONIZING BIT STRING
LOW ORDER DATA
HIGH ORDER DATA
1ST BYTE
2ND BYTE
WRITING OF DISPLAY RAM DATA
START BYTE (DESIGNATION OF WRITING DISPLAY RAM DATA)
START BYTE (DESIGNATION OF READING CPU ADDRESS COUNTER)
FIG. 9(C)
SOD (OUTPUT)
D0 D1 D2 D3 D4 D5 D6 D7
LOW ORDER DATA
HIGH ORDER DATA
READING OF CPU ADDRESS COUNTER

DISPLAY CONTROL DEVICE

This is a divisional of application Ser. No. 08/327,912 filed Oct. 24, 1994, now U.S. Pat. No. 5,757,353.

BACKGROUND OF THE INVENTION

The present invention relates to display control technology and more particularly to scroll technology for use in liquid crystal driving control, fluorescent tube driving control and the like as what is effectively applicable to liquid crystal control devices for displaying characters in a dot matrix form by utilizing, for example, character generator ROMs (Read Only Memories).

A liquid crystal display device utilizing a character generator as a display control form comprises a display RAM for storing character codes (hereinafter called "DDRAM"), a character generator RAM or ROM for storing character patterns such as character fonts (hereinafter called "CGRAM or CGROM"), a display address counter for reading DDRAM by adjusting the DDRAM to a position at which a liquid crystal display panel is driven, and a liquid crystal driving circuit for driving the liquid crystal display panel. In this case, the central processing unit (hereinafter called "CPU") writes character codes corresponding to characters to be displayed on the liquid crystal display panel to DDRAM. The display address counter reads the DDRAM sequentially in conformity with the position at which the liquid crystal display panel is driven and reads character patterns from CGRAM or CGROM with the character code thus read as part of an address. The character patterns sequentially read are then sent as liquid crystal lighting/nonlighting data to a shift register in the liquid crystal driving circuit, and all liquid crystal driving circuits simultaneously output lighting/nonlighting voltage levels at a point of time data on one line is stored so as to drive the liquid crystal display panel. The control operation above needs repeating as many as the number of lines of characters, line by line for display, because each character is made up of a plurality of lines in the vertical direction.

When the liquid crystal display device employing character codes is used to continuously scroll a plurality of characters on a display screen to the left or right, there are two methods that are considered feasible. One method is to scroll display characters by sequentially incrementing or decrementing the read start address of a display address counter for reading DDRAM to shift the reading position of DDRAM character by character to the left or right. Whereas the other one is to scroll characters by causing CPU to shift character codes within DRAM character by character to the left or right to rewrite the code. The present inventors examined these methods and have found out the following problems. In the case of the former method, a plurality of display lines on the display screen are simultaneously scrolled, though the load applied to the CPU is light. In the case of the latter method, all the character codes in DDRAM corresponding to a specific scroll display line need rewriting each time the scroll position is shifted from one character to another, though a specific display line may be scrolled selectively, and this makes the load applied to the CPU heavy. In the former and letter methods both, moreover, scrolling can be carried out only in characters and if it is attempted to scroll a plurality of characters continuously, the display characters will not move laterally and smoothly on the display screen, thus rendering the scroll display discrete and unnatural.

On the other hand, there is a bit map type liquid crystal display control device as another display control form. The display control device of this type is capable of visually providing smooth scrolling. More specifically, a liquid crystal display control device which is loaded with a bit map memory (hereinafter called "BPRAM") possessing lighting/nonlighting display data in pixels is used and CPU itself generates character patterns, directly writes the character pattern to the BPRAM, and rewrites the data stored in the BPRAM by shifting the data corresponding to a specific display line pixel by pixel to the left or right. Even in this case, however, the present inventors took notice of the fact that there had also arisen the following problems. In comparison with a liquid crystal display control device employing character codes, this liquid crystal display control device in question needs a large-capacity BPRAM, and also unavoidably causes the CPU to frequently rewrite the data in the BPRAM, thus making the load applied to the CPU extremely heavy. In order to carry out smooth scrolling, moreover, the liquid crystal display control device is of not practical use unless the CPU has high processing capability. As an example of a reference document describing display control technology with reference to character generator and bit map systems, there is "Microcomputer Handbook, p-171," published by Ohm Company on Dec. 25, 1985.

SUMMARY OF THE INVENTION

It has been hardly possible for conventional liquid crystal display control devices having a built-in character generator of such a dot matrix type to provide smooth scrolling and to effect the smooth scrolling selectively for not only a specific display line but also a specific display digit on the specific display line. In the case of the liquid crystal display control device loaded with the BPRAM, the CPU is made to totally control character patterns. Consequently, scrolling any desired display line may actually be fulfilled by means of software. However, the CPU is required to rewrite the whole contents of the BPRAM corresponding to the scroll display line each time one pixel is moved and the load applied to the CPU becomes considerably heavy.

Further, the present inventors have found out that when the liquid crystal display control device is operated under the control of the CPU such as a microcomputer or a data processor, the scope for the selection of any utilizable CPU for controlling such a liquid crystal display control device is narrowed on condition that read/write data in the display RAM and the interface procedure of control data transmission are uncommon and that the CPU tends to bear a heavier load. The present inventors have also discovered that provided the foregoing problems in connection with smooth scrolling are solved, it will improve the efficiency of control data transmission necessary for carrying out smooth scrolling in any display lines, display digits and dots.

An object of the present invention is to provide a display control device capable of achieving smooth scrolling under the control of display in the form of a character generator.

Another object of the present invention is to provide a display control device capable of achieving smooth scrolling for not only any desired display line but also any desired display digit.

Still another object of the present invention is to provide a display control device capable of achieving smooth scrolling by reducing the load applied to CPU.

A further object of the present invention is to provide a display device capable of contributing to broadening the scope for the selection of CPU utilizable for smooth scrolling in view of interfacing with the CPU.

A still further object of the present invention is to provide a display device capable of interfacing with CPU such as a data processor or a microcomputer simply using serial clock and as what will not practically restricting the CPU utilizable as a main control.

These and other objects of the invention will become more apparent in the detailed description taken in connection with the accompanying drawings.

A brief description will subsequently be given of a representative liquid crystal display control device embodying the present invention disclosed in this patent application.

A display control device for controlling a display device for displaying a pattern having a plurality of pixels on a number of display elements arranged at intersections of scanning and signal electrodes in a dot matrix form with the predetermined number of digits, the display control device comprising:

a first drive circuit for driving the scanning electrodes in time-sharing, a second drive circuit for driving the signal electrodes while holding a pixel data row at each driving switch interval of the scanning electrode, a display RAM capable of storing code data exceeding the predetermined number of digits, a pattern data memory for outputting pixel data on the display pattern corresponding to the code data sequentially read from the display RAM, a pixel data-row supply circuit for receiving the pixel data rows sequentially output from the pattern data memory, shifting the timing of supplying the pixel data row to the second drive circuit by a predetermined quantity on a pixel data basis, and a scroll quantity control circuit for variably controlling the quantity of shifting the output timing of the pixel data-row supply circuit.

In order to make variable a display line to be scrolled, a scroll display line control circuit for variably controlling the display line of a pixel data-row whose output timing is to be shifted by means of the pixel data-row supply circuit.

In order to provide the pixel data-row supply circuit in the form of a shift circuit, the pixel data-row supply circuit is provided with a shift circuit for holding in series the pixel data rows sequentially output from the pattern data memory sequentially in pixels, and a selection circuit for selecting one of the input and output nodes at each storage stage of the shift circuit to make the selected node its output. In order to ensure greater freedom in the setting of the shift quantity of the pixel data row and altering the timing thereof and to allows the scroll mode to be optionally designated, a first storage circuit may be employed for the scroll quantity control circuit as what rewritably stores the scroll quantity for use in designating the shift quantity of the output timing in the data-row supply circuit. For the scroll display line control circuit for allowing any scroll line to be designated with this arrangement, moreover, there may be provided a second storage circuit for rewritably storing the scroll line, a line detection circuit for detecting whether or not the present display line coincides with the scroll. line designated by the second storage circuit, and a gate circuit for allowing the scroll quantity held in the first storage circuit to be supplied to the selection circuit when the line detection circuit detects the coincidence above.

With this arrangement, further, there may be provided a third storage circuit for rewritably storing a scroll digit to be scrolled on the scroll line, a digit detection circuit for detecting whether or not the present display digit coincides with the scroll digit designated by the third storage circuit, and a gate circuit for allowing the scroll quantity held in the first storage circuit to be supplied to the selection circuit when the line and digit detection circuits detect the coincidence above.

For the scroll quantity control circuit for updating the scroll rate and the scroll quantity autonomously and sequentially, there may be provided a circuit for generating a scroll cycle signal for regulating the scroll operation, that is, the time interval of the scroll rate, and a scroll counter for updating the scroll quantity for use in designating the shift quantity of the output timing of the data-row supply circuit in synchronization with the scroll cycle signal fluctuation. In order to perfect the automonous control operation, there may additionally be provided a fourth storage circuit for rewritably storing first control data for designating the cycle of the scroll cycle signal to the circuit for generating the scroll cycle signal, second control data for designating the counting direction to the scroll counter and third control data for indicating the whole scroll quantity, and a scroll termination detection circuit for resetting the scroll counter for detecting that the output of the scroll counter has attained the third control data stored in the fourth storage circuit.

When CPU such as an external data processor or a microcomputer sets data in the first, second or third storage circuit, an interface is provided relative to such a circuit. The interface circuit is provided with an internal bus connected to the input of the storage circuit; a serial clock input terminal; a serial data input terminal; a serial storage circuit which is connected to the serial data input terminal and has a plurality of latch circuits; a parallel data latch circuit whose parallel input terminal is connected to the output nodes of the respective latch circuits of predetermined stages contained in the serial storage circuit and whose parallel output terminal is connected the internal bus; a synchronizing bit string detection circuit having an input terminal connected to the input of the parallel data latch circuit and an input terminal connected to the output of the other latch circuit out of the plurality of latch circuits, and outputting a first signal when the input is a predetermined logical value; an access control data latch circuit for fetching the data stored in the latch circuit other than those whose outputs are connected to the logical circuit by means of the first signal, and a transfer control counter whose counting operation is reset by the first signal and which is used for controlling the latch timing of the parallel data latch circuit.

When the interface circuit supports the data output, the interface circuit is provided with a serial data output terminal, and a parallel/serial conversion circuit whose input is connected to the internal bus in parallel and whose output is connected to the serial data output terminal, the serial output being synchronized with the serial clock signal. The transfer control counter further generates a control signal for controlling the output start timing of the parallel/serial conversion circuit according to the count.

With the means above, the scroll quantity control circuit controls the degree of shifting the pixel data row supplying timing on, for example, a pixel data basis, whereby the pixel data row for driving the signal electrode delivered to the second drive circuit from the pixel data row supply circuit becomes equivalent to the pixel data row sequentially generated from the pattern data memory. Thus the instruction of increasing or decreasing the shift quantity every display period of a plurality of frame is given to the scroll quantity control circuit, whereby smooth scrolling in pixels in the direction of the display digit on the predetermined display line is achieved. When the scroll control circuit is formed of the first storage circuit like the scroll dot quantity register, for example, the CPU periodically rewrites the scroll quantity of the first storage circuit, so that the predetermined display line is smoothly scrolled. The rewriting of the shift quantity of the scroll dot or the rate of change thereof needs not necessarily be based on a one pixel unit but on the plurality of pixels smaller in number than dots in the direction of the digit of a simple pattern.

When the scroll display line control circuit is employed, the smooth scrolling with respect to single or the plurality of display lines designated thereby is implemented.

The designation of the shift quantity may be fixed every other pixels and the intended scroll line may also be fixed. With the provision of the first and second storage circuits, the intended scroll display line and the scroll quantity may be designated as programmable, depending on the set value, and by gradually increasing or decreasing the shift quantity, scrolling can freely be carried out side by side to either direction. With the provision of the third storage circuit, any desired display digit only on the intended scroll display line may be scrolled.

In the case of the smooth scrolling in the character generator system, it is unnecessary to rewrite the data in the display RAM which stores the character codes and in view of this, the load applied to the CPU is reducible and the software can also be simplified. Since the sequential rewriting of a large-capacity memory as in the case of the bit map memory is unnecessary, the load applied to the CPU is reduced in comparison with the display control in the bit map system, so that the smooth scrolling is realized.

With the provision of the scroll quantity control circuit for updating the scroll rate and the scroll quantity automonously, the CPU need not sequentially perform the process of altering the scroll quantity per scrolling for one or more than one pixel, for example, the process of rewriting the value of the first storage circuit. Moreover, no time control for equalizing the rewriting intervals, that is, the intervals of scroll operations is required. For this reason, the load applied to the CPU in connection with the smooth scrolling is greatly reduced. As the scroll quantity control circuit is additionally provided with the function of resetting the scroll counter, the CPU is to complete the control of smooth scrolling with the overall scroll quantity required once it sets the desired control data.

Controlling the data transmission in bytes, for example, by resetting the transfer control counter in synchronization with the detection of the synchronizing bit string synchronized with the serial clock signal functions as what resets the transmission procedure to the normal condition in response to the detection of the next synchronizing bit string even though the shifting of data bits arises between the CPU and the display control device.

The provision of the serial data output terminal allows the synchronizing bit string and the access control data which follows to be monitored on receiving the output of the serial input terminal even during the reading operation performed by the CPU, whereby write/read switching can be achieved by three of interface signals including the serial clock signal, the serial input signal and the serial output signals.

BRIEF DESCRIPTION OF THE DRAWINGS

FIGS. 9(A), 9(B), 9(C) are diagrams illustrating operating procedures when the serial reading operation is changed to the serial writing operation.

DESCRIPTION OF THE PREFERRED EMBODIMENTS

Figure 1:
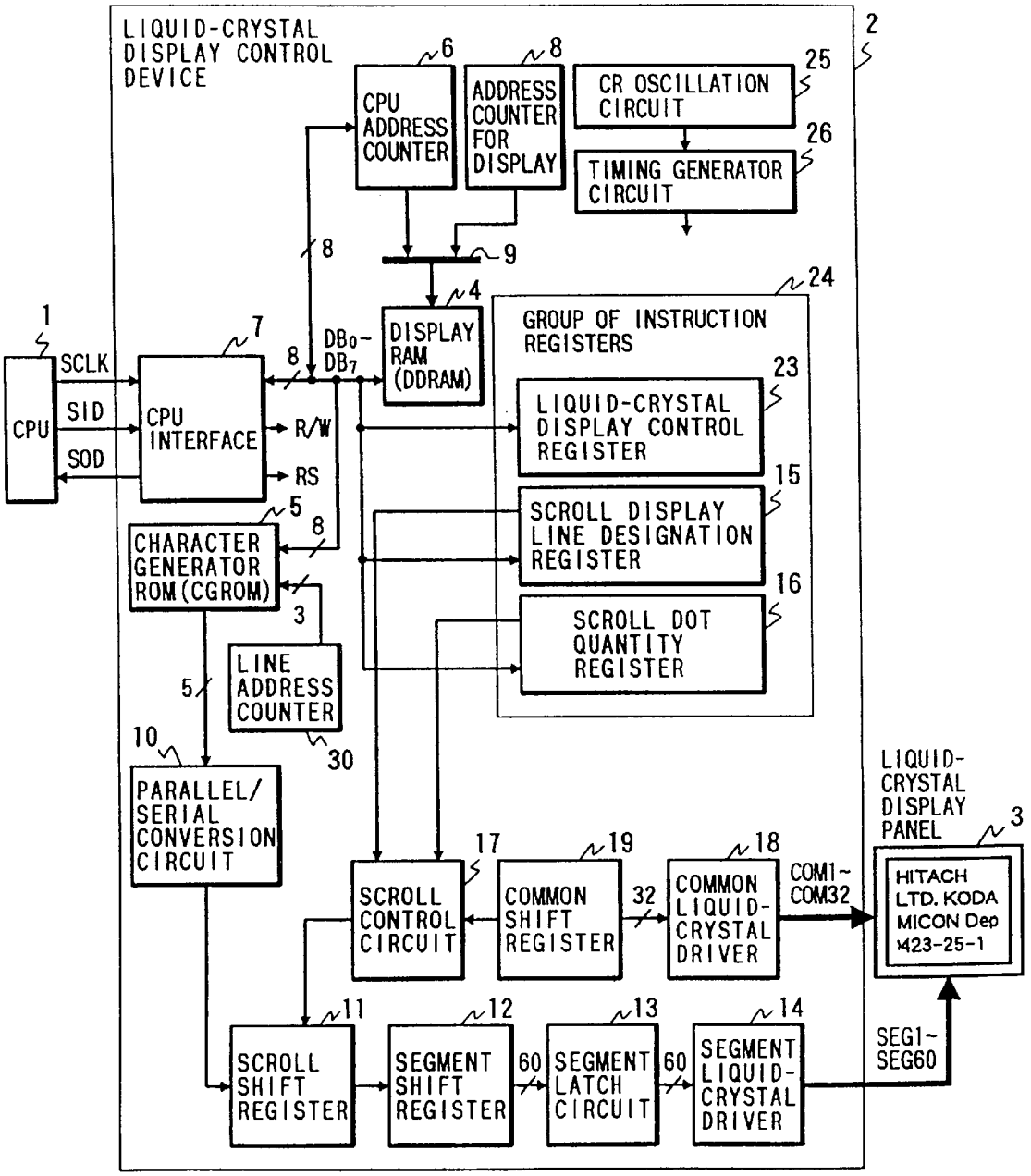
FIG. 1 is a block diagram of a first embodiment of a liquid crystal display control device of the present invention.

FIG. 1 is a block diagram of a system employing a liquid crystal display control device embodying the present invention. This system is provided with, not exclusively, a liquid crystal display control device 2, CPU 1 (Central Processing Unit) as a data processor or a microcomputer for controlling the operation of the liquid crystal display control device 2 and a liquid crystal display panel (also referred to as an LCD panel) 3. The liquid crystal display control device 2 is equipped with a display RAM (Random Access Memory) 4 for storing character codes of characters to be actually displayed on a liquid crystal display screen and a character generator ROM (Read Only Memory) 5 for developing a character font pattern in a dot matrix form from the designated character code.

The liquid crystal display panel 3 is formed with, not exclusively, a dot matrix, and a 1-dot liquid crystal element is formed at each intersection of common electrodes (not shown) as scanning electrodes and segment electrodes (not shown) as signal electrodes respectively arranged crosswise in directions of X and Y. When the common electrodes are sequentially driven, it is determined by the display signal given to the segment electrode whether a display element corresponding to the common electrode to be driven is lighted or not. According to the present embodiment of the invention, the liquid crystal display panel 3 is provided with, not exclusively, a display area where character display can be made with maximum 12 digits·4 lines and the number dots (the number of display elements) per display character is set to length×width=5×8 dots. The liquid crystal display panel 3 based on the arrangement above has 32 common electrodes and 60 segment electrode.

By writing the character code of a character to be display to the display RAM 4, the CPU 1 allows any given character to be displayed at any given position. The display RAM 4 has a storage area capable of storing character codes exceeding the maximum number of display digits that can be displayed on the liquid crystal display panel 3 in accordance with the scrolling direction as will be described later; for example, it is capable of storing character codes equivalent to 20 digits·4 lines.

When the display RAM 4 is written, the character code is written to the address designated by a CPU address counter 6. the CPU 1 is allowed to preset any desired initial address value intended for the CPU address counter 6, which is incremented synchronously each time the CPU 1 instructs the display RAM 4 to write thereafter, so that a necessary address is generated therein. The address signal which is output from the CPU address counter 6 is supplied via a selection circuit 9 to the display RAM 4. The display character code as write data at this time is given by the CPU 1, for example, via a CPU interface 7. Data transmission between the liquid crystal display control device 2 and the CPU 1 is conducted via the CPU interface 7.

The read address in the display RAM 4 during the display operation is generated by a display address counter 8. In other words, the display address counter 8 performs a sequential decrement operation, for example, in synchronization of the display operation and outputs the resulting value. The value thus output is supplied via the selection circuit 9 to the display RAM 4 and a display character code (hereinafter may be called the "character code") is read from the display RAM 4. The display character code has 8 bits, not exclusively.

Access to data in the display RAM 4 in order to rewrite or read the data (CPU access) and access to data in the display RAM 4 to read the data for liquid crystal display (display access) are alternately gained by the CPU 1 in time-sharing, not exclusively, and the selection mode of the selection circuit 9 is controlled accordingly so that it is alternately and synchronously switched. A timing generator circuit 26, which will be described later, assumes control of the sort mentioned above.

The character code read from the display RAM 4 during the display operation is made part of an access address signal with respect to the character generator ROM 5 and the remainder of the access address signal is output from a line address counter 30.

The aforesaid character generator ROM 5 stores font pattern data including alphanumeric characters, alphabets, katakana, hiragana, kanji and symbols. Character codes are allocated to the respective these characters, not exclusively. With 5 dots (5 bits according to this embodiment of the invention) per font data on one character designated by the character code, the character generator ROM 5 can be read through eight read operations in total. In other words, the character generator ROM 5 makes the character code read from the display RAM 4 correspond to high order 8 bits of the address and allows the output of the line address counter 30 to be accessed for reading as low order 3 bits of the address. The character code forming the high order 8 bits of the address is regarded as a signal for designating a character, whereas the 3-bit output of the line address counter 30 is considered as a signal for designating the vertical eight lines of the character font designated by the character code line by line.

The font pattern data read from the character generator ROM 5 (the reading of font pattern data like this may also be called a development of the font pattern) are converted to serial data in a parallel/serial conversion circuit 10 and sequentially sent via a scroll shift register 11, which will be described later, to a segment shift register 12 (equivalent to 60 bits according to this embodiment of the invention). At a point of time data equivalent to one line (one scanning line or a common electrode on the liquid crystal display panel 3) are totally stored in the segment shift register 12, a segment latch circuit 13 is made to latch the data involved, which is fed into a segment liquid crystal driver 14. The segment liquid crystal driver 14 forms segment drive signals SEG1–SEG60 for controlling the selection (lighting) or non-selection (non-lighting) of each display element, that is, each pixel on the liquid crystal display panel according to the output data of the segment latch circuit 13 and drives the segment electrode of the liquid crystal display panel 3. The common electrodes on each line are sequentially driven in time-sharing by common drive signals COM1–COM32 formed by a common shift register 19 and a common liquid crystal driver 18. The common drive signals are formed in the order of COM1-to-COM21, for example.

The timing generator circuit 26 for receiving the output of a CR oscillation circuit 25 generates the internal timing if the liquid crystal display control device. The timing signal thus generated is used for generating the increment timing of the display address counter 8 and the line address counter 30, the shift timing of the common shift register 19, the shift timing of the scroll shift register 11 and the segment shift register 12, and the latch timing of the segment latch circuit 13. The shift timing of the scroll shift register 11 and the segment shift register 12 is determined by a dot clock signal. With respect to the various kinds of timing above, the common electrodes are sequentially driven and the driving timing of the segment electrodes is determined by synchronizing the operating timing of such as the common liquid crystal driver 18 and the segment liquid crystal driver 14 with the operation of the display address counter 8 and the line address counter 30 so that the data sequentially read from the character generator ROM 5 may be displayed at the respective positions where they are displayed.

In FIG. 1, reference numeral 24 denotes a group of instruction registers including a liquid crystal display control registers 23, a scroll display line designation register 15, a scroll dot quantity register 16 and the like, these being set by the CPU 1 via the CPU interface 7. When the scroll operation is performed laterally on the liquid crystal display panel 3, the CPU 1 writes scroll information via the CPU interface 7 to the scroll display line designation register 15 for designating a display line to be scrolled and the scroll dot quantity register 16 for designating a scroll amount pixel by pixel. In this case, the character code data in the display RAM 4 need not be rewritten. The data stored in the scroll display line designation register 15 and the scroll dot quantity register 16 are fed into a scroll control circuit 17, which controls the scroll shift register 11.

Figure 2:
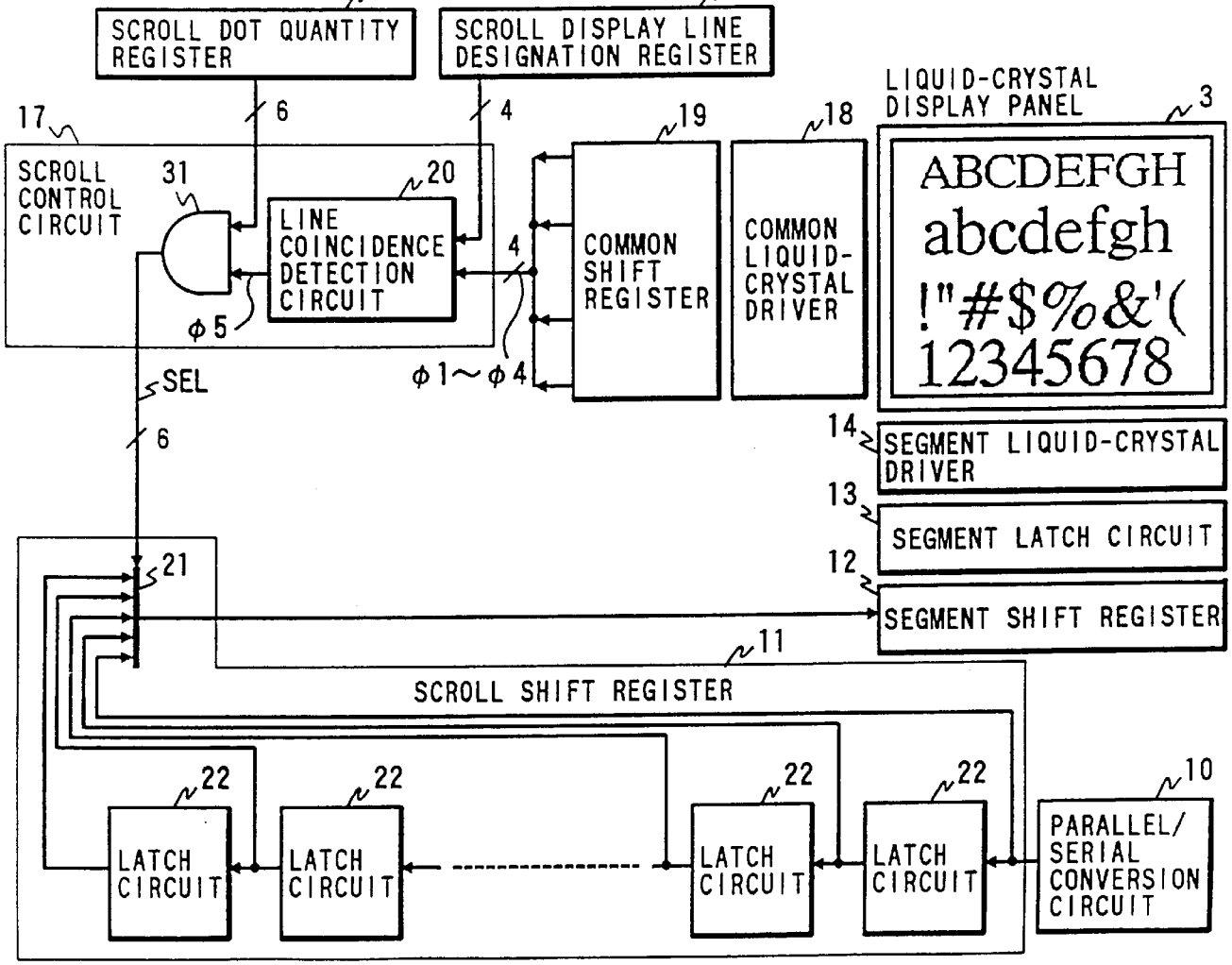
FIG. 2 is a diagram illustrating an exemplary scroll control circuit in detail.

FIG. 2 is a detailed circuit diagram for scrolling. When four lines of a character font pattern constituted by 5×8 dots are displayed vertically, the common liquid crystal driver 18 has 32 drive circuits in total as each display character line comes up to eight lines. The common liquid crystal driver 18 supplies common drive signals COM1–COM32 to three common electrodes of the liquid crystal display panel 3 and further supplies selection voltage levels in time-sharing to common electrodes equivalent to 32 lines from the first to fourth character lines. The order in which the common liquid crystal driver 18 sequentially outputs the selection voltage levels is controlled by the common shift register 19.

Figure 3:
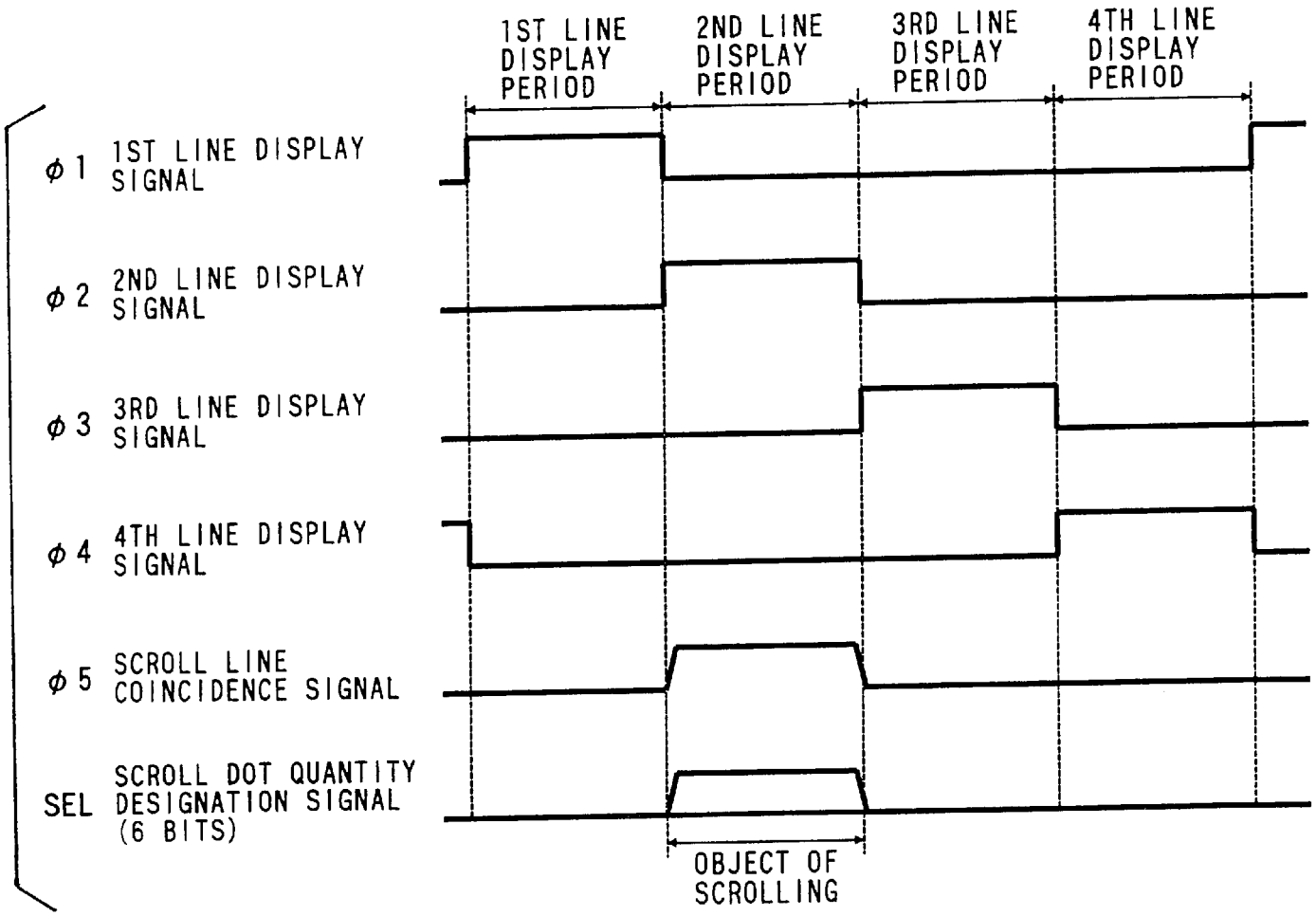
FIG. 3 is a timing chart showing exemplary timing of generating a display line signal, a scroll display line designation signal and the like in the scroll control circuit of FIG. 2.

The common shift register 19 has 32 serial storage stages and each time one line is driven, for example, bit data having a predetermined logical value (e.g., 1) is shifted stage by stage. After the bit data is shifted to the last stage, the timing generator circuit 26 continuously supplies the bit data to the initial stage again, so that the cyclic operation is repeated. Since the common shift register 19 sequentially selects the first to fourth character lines, it is recognizable which one of the display character lines is selected then by reference thereto. Therefore, the common shift register 19 sequentially outputs display line signals $\phi$1–$\phi$4 being displayed as shown in FIG. 3. For example, the first line display signal $\phi$1 may be understood to be a signal resulting from ORing the outputs at the respective storage stages ranging from the initial to 8th stages of the shift register 19. The scroll control circuit 17 has a line coincidence detection circuit 20 for comparing the 4-bit display line signals $\phi$1–$\phi$4 which are output from the common shift register 19 with the 4-bit set value of the scroll display line designation register 15 bit by bit and detecting a case where these agree with a logical value of 1. When the results of comparison coincide, a scroll line coincidence signal $\phi$5 which is output from the line coincidence detection circuit 20 is set at a high level during the period as shown in FIG. 3. For example, four bits of the scroll display line designation register 15 are made the designation bits of the first to fourth display character lines and each of the four bits which are set in the scroll display line designation register 15 is such that the logical value 1 is regarded as scroll designation. The line coincidence detection circuit 20 ANDs the bits of the designation register 15 with the display signal of the corresponding line and obtains one scroll line coincidence signal $\phi$5 by ORing the 4-bit AND signals.

The scroll dot quantity register 16 stores data of six bits, not exclusively, each of which is input to a gate circuit 31. When the scroll line coincidence signal $\phi$5 is at the high level, the gate circuit 31 makes the output of the scroll dot quantity register 16 a scroll dot quantity designation signal SEL and transfers the latter to the scroll shift register 11. When the scroll line coincidence signal $\phi$5 is at a low level, the gate circuit 31 supplies to the scroll shift register 11 the signal SEL whose all six bits have, for example, a logical value of 0. The gate circuit 31 comprises, for example, six two-input AND gates for receiving the output of the scroll dot quantity register 16 on a bitwise basis and for commonly receiving the scroll line coincidence signal $\phi$5. Therefore, the scroll dot quantity designation data stored in the scroll dot quantity register 16 is supplied as the scroll dot quantity designation signal SEL to the scroll shift register 11 only when the display line on the panel 3 agrees with the scroll line designated by the register 15.

The scroll shift register 11 comprises multiple-stage latch circuits 22 connected in series and a multiplexer 21. Each of the latch circuits 22 stores bit data of one dot and sequentially transfers serial data which are output from the parallel/serial conversion circuit 10 to the following stage in synchronization with the output of the parallel/serial conversion circuit 10, that is, the dot clock signal. On receiving the output of the parallel/serial conversion circuit 10 and that of each latch circuit 22, the multiplexer 21 selects one of those inputs according to the decoded result of the 6-bit output of the gate circuit 31 and supplies the selected one to the segment shift register 12. When the output of the gate circuit 31 is such that all the bits have a logical value of 0 at this time, that is, when no scrolling is carried out, the multiplexer 21 selects the output of the parallel/serial conversion circuit 10. When the scroll quantity of the scroll dot quantity register 16 is output from the gate circuit 31, the output of the latch circuit of the following stage is selected by the multiplexer 21 and transferred to the segment shift register as the scroll quantity designated by the scroll dot quantity register 16 increases, that is, the output value of the gate circuit 31 is increased.

When the results of comparison in the line coincidence detection circuit 20 coincide like this, the scroll line coincidence signal $\phi$5 that is output from the circuit 20 is set at the high level for only the corresponding period, and the multiplexer 21 selects the result shifted by the scroll shift register 11 to the extent. of the number of scroll pixels set by the scroll dot quantity register 16 and supplies a character pattern to the segment shift register 12. When five pixels are scrolled in a certain instance during the display period, for example, the multiplexer 21 selects the character pattern data shifted in the latch circuits 22 of five stages within the scroll shift register 11 and the supplies the data to the segment shift register 12.

As noted previously, the display RAM 4 has storage areas in which character codes equivalent to maximum 20 digits·4 lines can be stored. Access to the data stored in the display RAM 4 is had by the decremental display address counter 8, for example, from the 20th digit storage area up to the first digit one in order. Although the segment shift register 12 is in 60-bit configuration so as to correspond to 12 digits as the maximum number of display digits of the liquid crystal display panel 3, the timing at which a pattern data of one display line is transferred from the segment shift register 12 to the segment latch circuit 13 is set so that the pattern data is transferred each time the segment shift register 12 performs the shift operation 100 times corresponding to the maximum number of storage digits of the display RAM 4. The shift operation is performed in synchronization with the dot clock signal as in the case of the latch operation of the latch circuit 22. When pattern data equivalent to one display line is output from the scroll shift register 11 as what becomes delayed by a predetermined number of dots, a display which has been shifted to the left of FIG. 2 by that number of dots is made achievable. If the value of the scroll dot quantity register 16 is sequentially incremented at predetermined time intervals, for example, display periods of more than one frame (i.e., if the output of the latch circuit of the following stage is selected sequentially), bit by bit scrolling to the left of FIG. 2 is made achievable. If, conversely, the initial value of the scroll dot quantity register 16 is sequentially decremented, scrolling to the right is made achievable.

When the line designated by the scroll display line designation register 15 does not agree with a line being displayed, no scrolling is carried out and an ordinary display is made as the scroll line coincidence signal remains at the low level. In other words, the character pattern data is not passed through the latch circuits in the scroll shift register 11 but the output of the parallel/serial conversion circuit 10 is directly supplied from the multiplexer 21 to the segment shift register 12.

The scroll display line designation register 15 can be set in display lines and when four lines are displayed, for example, it has independent 4-bit data. Since the scrolling of each display line is individually designated, a plurality of lines can be scrolled simultaneously. Moreover, any desired number of pixels to be scrolled can be designated by varying the value set in the scroll dot quantity register 16, so that scrolling from side to side is made achievable by sequentially incrementing or decrementing the set value. The scroll rate may also be changed by adjusting the interval of incrementing or decrementing the set value. By combining the scroll display line designation register 15 with the scroll dot quantity register 16, only a desired display line is allowed to be scrolled from side to side selectively and smoothly.

Figure 4A:
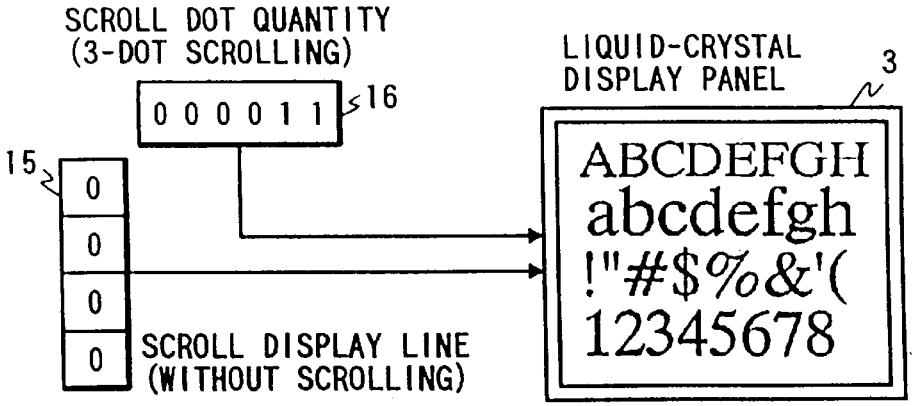
FIGS. 4(A), 4(B), 4(C) are diagrams illustrating exemplary operations of selectively scrolling only the designated display lines.
Figure 4B:
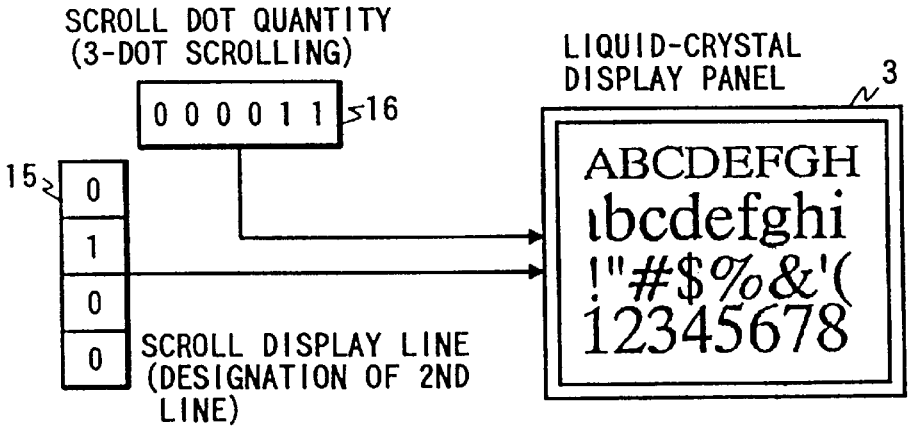
Figure 4C:
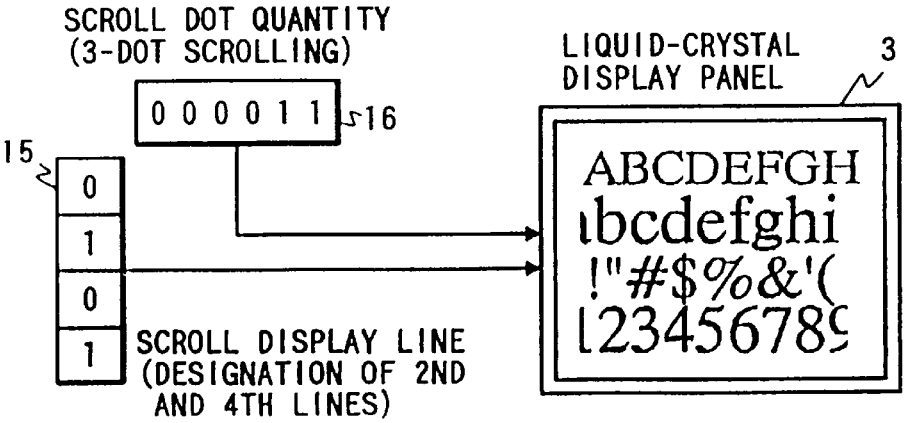

FIGS. 4(A)–4(C) refer to cases where scrolling is carried out independently in display lines. Four bits of the scroll display line designation register 15 respectively correspond to display lines on the liquid crystal display panel 3. As shown in FIG. 4(A), no scrolling is carried out even though the scroll dot quantity is designated by the scroll dot quantity register 16 when the contents of the scroll display line designation register 15 are totally "0". Whereas when the second bit of the scroll display line designation register 15 is "1" as shown in FIG. 4(B), only a display line corresponding to this bit an be scrolled according to the set value of the scroll dot quantity register 16. When two bits are set to "1" as shown in FIG. 4(C), further, display lines respectively corresponding to the two bits are allowed to be simultaneously scrolled. As is obvious from FIGS. 4(A)–4(C), the display line thus designated is in such a state that it has been shifted to the left in proportion to the scroll dot quantity.

Figure 5A:
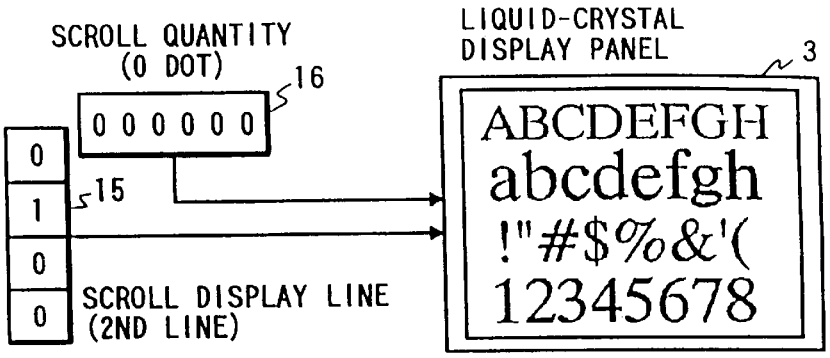
FIGS. 5(A), 5(B), 5(C), 5(D) are diagrams illustrating exemplary operations of selectively scrolling only the designated display lines when the set value of scroll dot quantity is varied.
Figure 5B:
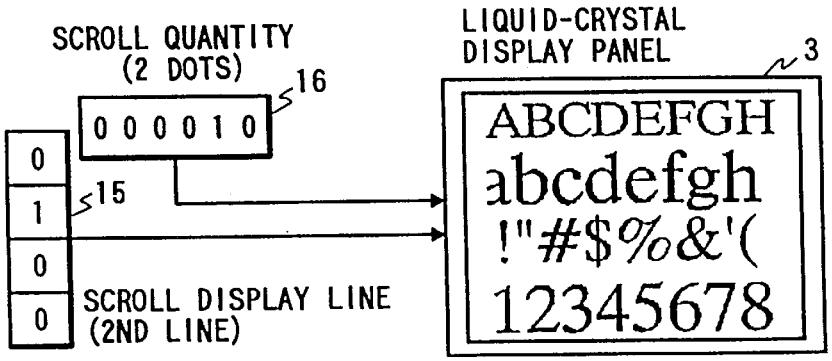
Figure 5C:
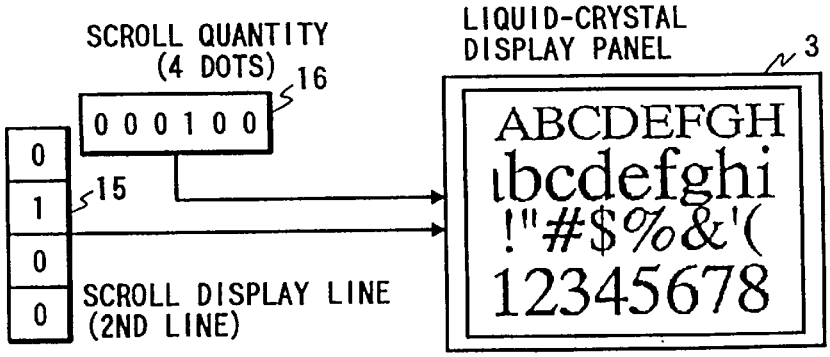
Figure 5D:
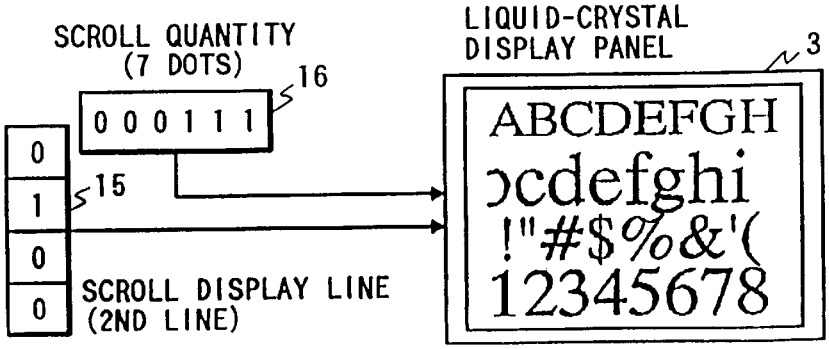

FIGS. 5(A)–5(D) show display examples when the scroll quantity is varied, wherein scrolling the pixel unit designated by the scroll dot quantity register 16 is made feasible. By periodically and sequentially incrementing the set value of the scroll dot quantity register 16, the display line designated to be scrolled can be scrolled from side to side smoothly on the liquid crystal display panel 3. In FIGS. 5(A)–5(D), only the second line (abcdefgh) is designated to be scrolled, whereas the other lines remain to be not so designated. In other words, only the second lines in FIGS. 5(B), 5(C) and 5(D) are scrolled in contrast to FIG. 5(A).

Figure 6:
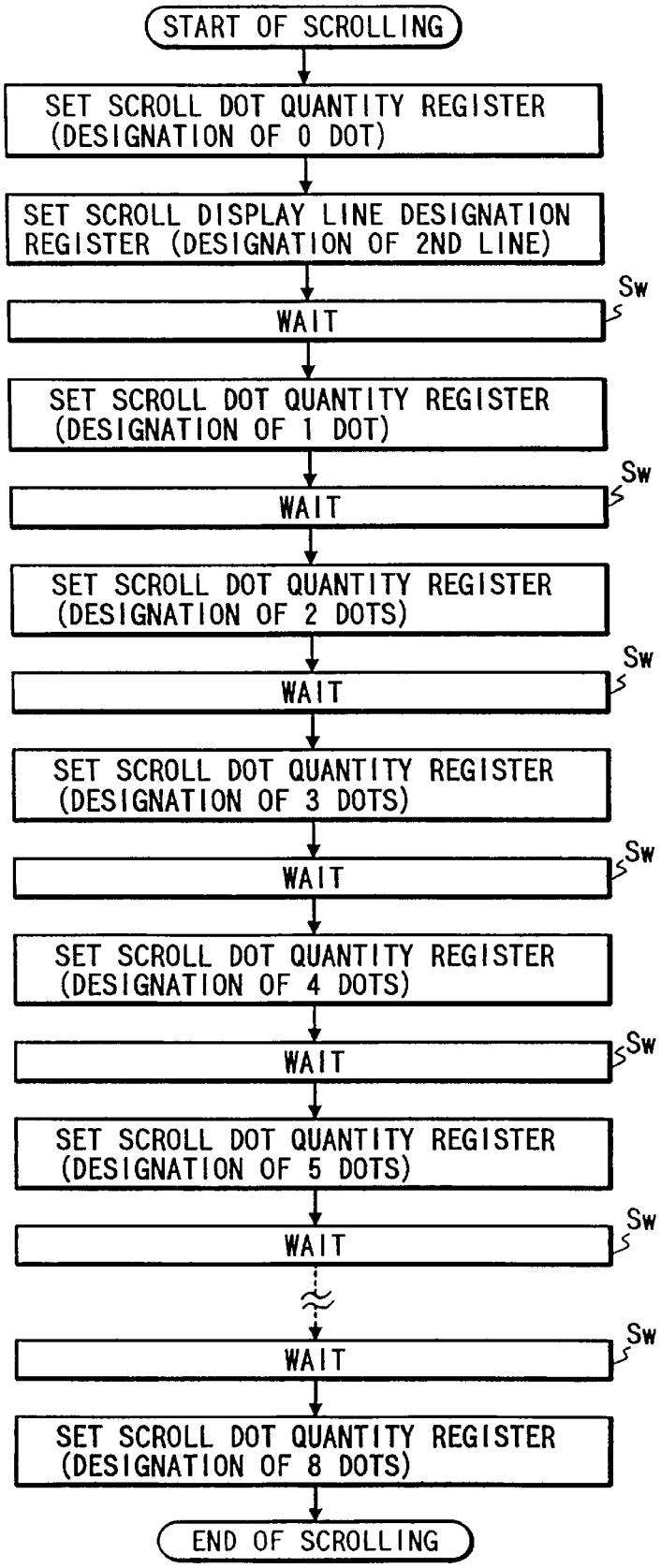
FIG. 6 is a flowchart illustrating a control flow by means of CPU when smooth scrolling is made pixel by pixel.
Figures 7A, 7B, 7C, 7D:
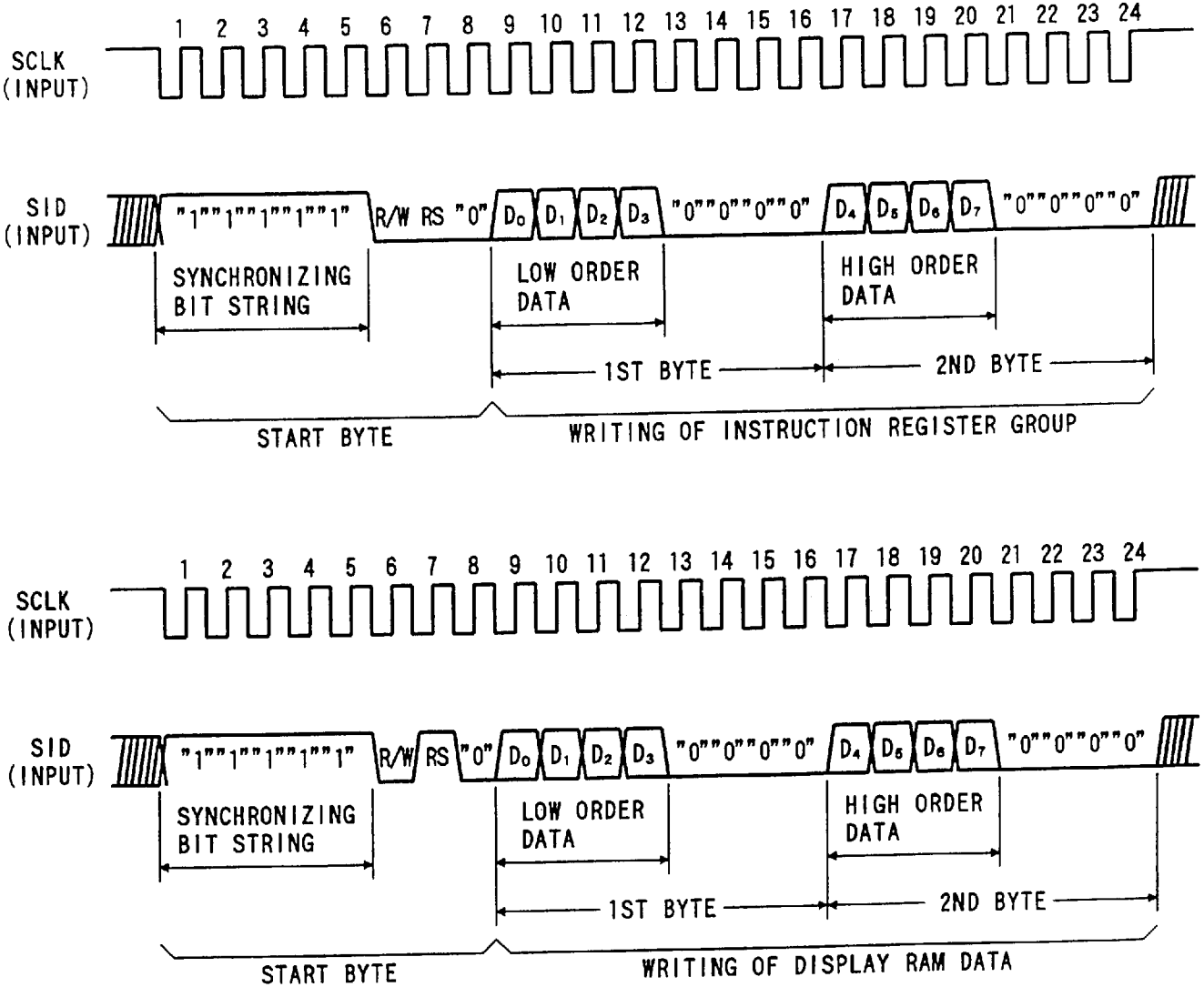
FIGS. 7(A), 7(B), 7(C), 7(D) are diagrams illustrating writing procedures when data is serially transferred between CPU and the liquid crystal display control device.
Figures 8A, 8B, 8C, 8D, 8E, 8F:
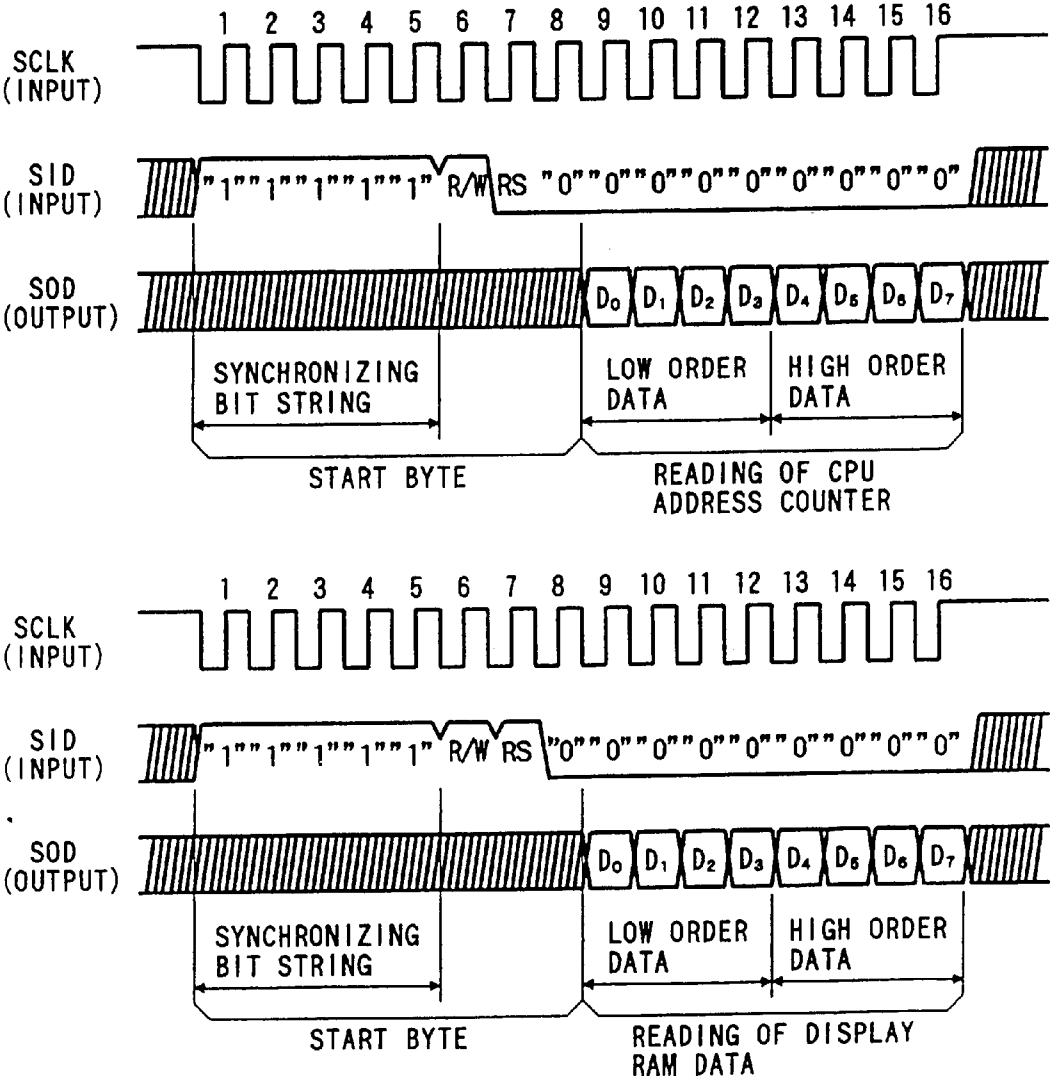
FIGS. 8(A), 8(B), 8(C), 8(D), 8(E), 8(F) are diagrams illustrating reading procedures when data is serially transferred between CPU and the liquid crystal display control device.

FIG. 6 is a flowchart showing a software control procedure by means of CPU 1 to scroll eight pixels continuously and smoothly pixel by pixel for a specific display line. The scroll dot quantity register 16 is cleared to reduce the scroll dot quantity to "0" before scrolling is started. Further, a display line to be scrolled is set in the scroll display line designation register 15. Scrolling is started by setting one pixel in the scroll dot quantity register 16 and pixel by pixel scrolling to the left can be carried out smoothly by altering the setting of the scroll dot quantity in the scroll dot quantity register 16 so as to increase the quantity gradually. In addition, scrolling to the right can also be carried out continuously and smoothly by altering the setting of the scroll dot quantity in the scroll dot quantity register 16 so as to decrease the quantity gradually. In order to carry out scrolling smoothly in consideration of the reaction rate of liquid crystal, interval time (wait step Sw) needs to be inserted in the timing at which the scroll dot quantity register 16 is incremented or decremented. The liquid crystal display control device 2 is caused to repeatedly display one and same frame during the interval period. The CPU 1 is allowed to change the smooth scroll execution time by regulating the interval time.

The transmission and reception of data between the CPU 1 and the liquid crystal display control device 2 are made via the CPU interface 7 within the liquid crystal display control device 2. The liquid crystal display control device 2 is equipped with three of interface signals intended for a serial data input terminal (hereinafter simply called the "SID") for the CPU 1 to write data, a serial data output terminal (hereinafter simply called the "SOD") for the CPU 1 to read data, and a serial transfer clock input terminal (hereinafter simply called the "SCLK") for indicating the timing of retrieving or reading the input data in the liquid crystal display control device 2.

FIGS. 7(A)–7(D) shows a writing procedure using the interface signals and FIGS. 8(A)–8(F) a reading procedure. The data which is input (SID) or output (SOD) is interfaced in synchronization with the serial transfer clock (SCLK). First, the CPU 1 inputs a start byte from the SID terminal when the transfer is started. When five bits of "1" are continuously input, the CPU interface 7 understands that the start byte has been started. The continuous "1" data row of five bits is defined as a synchronizing bit string. When the CPU interface 7 recognizes the synchronizing bit string, it regards a bit following the synchronizing bit string as an R/W bit and the next bit as an RS bit, and stores the state of the input bits. Incidentally, the entry of "0" into the last bit of the start byte is required. If the last bit is "1" when low order data D0–D3 that follow have totally four bits of "1", these may be recognized as a synchronizing bit string. It is therefore needed to prevent the data from being thus recognized. The R/W bit is a bit with which the CPU 1 instructs the liquid crystal display control device 2 to perform read/write operations, "0" and "1" meaning the read and write operations, respectively. Further, the RS bit above is a bit for selecting the resister, meaning the selection of the CPU address counter 6 or the group of instruction registers 24 when it is "0", and meaning the selection of the display RAM 4 when "1". The group of instruction registers 24 include the above-described scroll display line designation register 15, the scroll dot quantity register 16 and the liquid crystal display control register 23.

The relation between the R/W and RS bits and operating modes may be summarized as follows. When R/W bit=0 and RS bit=0, there enters an operating mode in which the set value is written to the CPU address counter 6 and the group of instruction registers 24. When R/W bit=0 and RS bit=1, there enters an operating mode in which data is written to the display RAM 4. When R/W bit=1 and RS bit=0, there enters an operating mode in which the count value from the CPU address counter 6 is read. When R/W bit=1 and RS bit=1, there enters an operating mode in which data from the display RAM 4 is read.

When writing is designated with the R/W bit in the start byte, a 8-bit data row is written with two bytes (16 bits) which follow the start byte. In other words, the 8-bit data row is divided into two of upper and low order 4-bit data rows. The low order 4-bit data row and four bits of continuous "0" are input by means of the next byte (low order byte) of the start byte, and the upper 4-bit data row and four bits of continuous "0" are input by means of the following byte (high order byte). Consequently, five bits or more of "1" will never appear consecutively over the SID except for the synchronizing bit string.

When reading is designated with the R/W bit in the start byte, a 8-bit data row is read from the SOD terminal with one byte (eight bits) which follows the start byte. Even while the data row is read from the SOD terminal, the 5-bit synchronizing bit string fed from the SID is being monitored. FIGS. 9(A)–9(B) shows a procedure for changing a reading sequence to a writing sequence. For example, the R/W bit of the first start byte is set to "1" and the RS bit to "0" in the first byte, whereby the contents of the CPU address counter 6 are read in the second byte. The R/W bit is set to "0" and the RS bit to "1" simultaneously in the second byte used for reading, and data is written to the display RAM 4 in the third and fourth bytes. Thus three of the interface signals SCLK, SID and SOD are used to attain the switching the writing operation to the reading operation and vice versa. When it is unnecessary read data from the liquid crystal display control device 2, two of the SCLK and SID terminals may be used for interfacing purposes.

With adoption of such an interfacing procedure, data transmission can be effected in operating modes simply in synchronization of the clock signals. In other words, no exclusive data transmission protocol using clock or timing signals having special waveforms is needed. Therefore, the CPU 1 for controlling the liquid crystal display control device 2 according to the present invention is requires only to have an ordinary serial interface or a port and this makes it feasible to utilize any general purpose CPU, thus increasing the general-purpose properties of CPUs.

Figure 10:
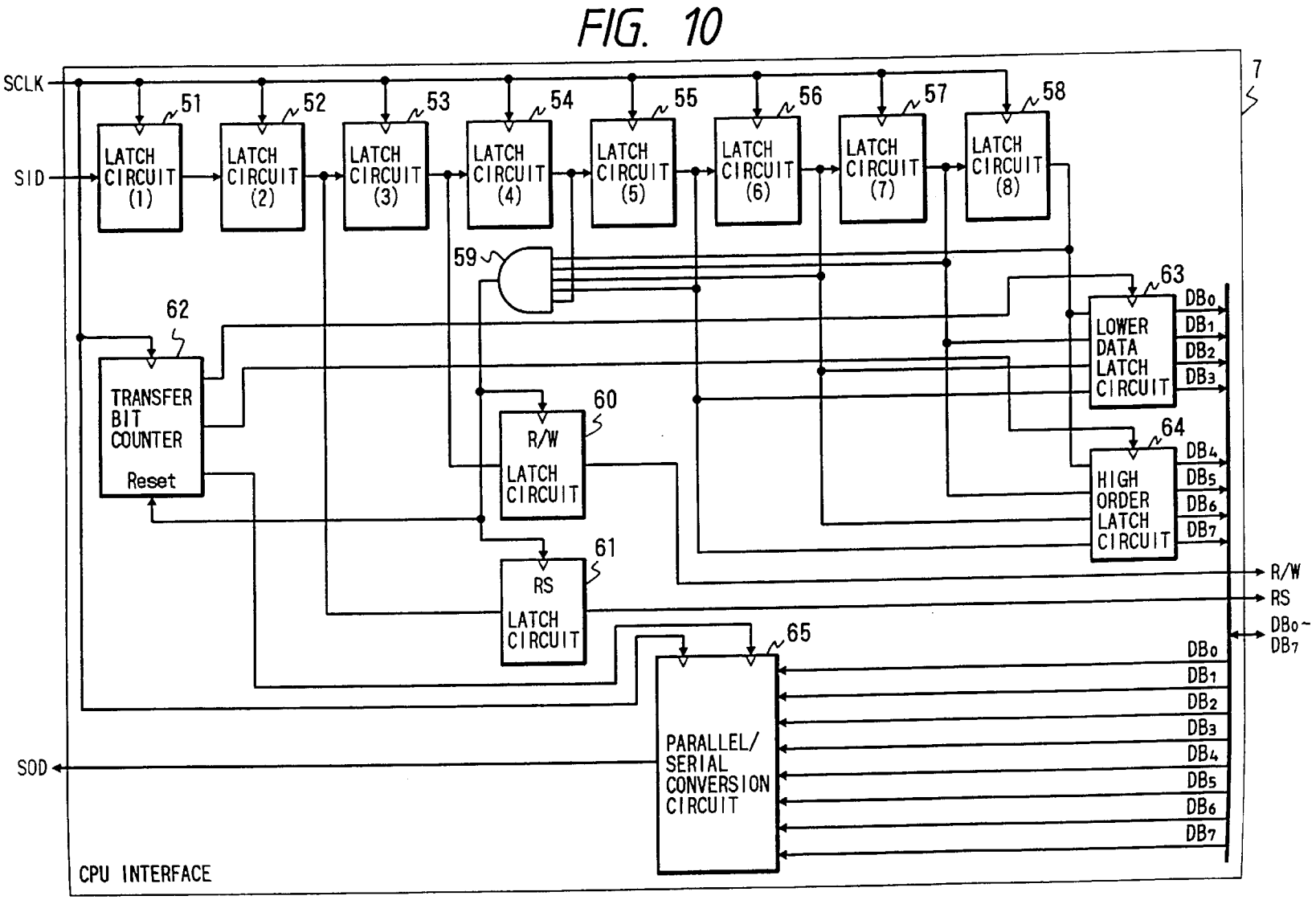
FIG. 10 is a detailed circuit diagram of an CPU interface in the liquid crystal display control device.

FIG. 10 is a block diagram illustrating the inside of the CPU interface 7. The data fed from the SID terminal is sequentially fetched by latch circuits (1) 51–(8) 58 coupled by cascade connection at the leading edge of the SCLK. A start synchronizing detection circuit 59 always monitors the outputs of the data fetched by the latch circuits (4) 54–(8) 58 and when the outputs become totally "1", acknowledges the entry of a synchronizing bit string. At a point of time the synchronizing bit string is detected, the start synchronizing detection circuit 59 regards the output data of the latch circuits (2) 52 and (3) 53 as RS and R/W bits and latches the outputs in an RS latch circuit 61 and an R/W latch circuit 60, respectively.

A transfer bit counter 62 generates latch timing at which a low order data latch circuit 63 and a high order data latch circuit 64 fetch effective data rows of low and high order four bits out of the data row received, respectively. The transfer bit counter 62 sequentially counts up the data at the SCLK. The outputs of the RS latch circuit 61, the R/W latch circuit 60, the low order data latch circuit 63 and the high order data latch circuit 64 are supplied to the respective blocks in the liquid crystal display control device 2 as an RS signal, an R/W signal, DB0–DB7 signals.

The transfer bit counter 62 is forced to be reset and initialized by means of the synchronizing bit string detected by the start synchronizing detection circuit 59. When the transfer condition at the time of power supply is unsettled or when the bits in the data rows which are dealt with by the CPU 1 and the CPU interface 7 deviate from each other because noise is introduced in the serial transfer clock input terminal (SCLK) during the transfer operation, the transfer procedure can be reset to the normal condition by initializing the transfer bit counter 62 by means of the synchronizing bit string.

The serial data is read by feeding the data serially output from a parallel/serial conversion circuit 65 to the CPU 1 from the SOD terminal at the trailing edge of the clock signal supplied from the serial transfer clock input terminal SCLK. The data supplied from each block in the liquid crystal display control device 2 is loaded via DB0–DB7 in the parallel/serial conversion circuit 65. This loading timing is supplied from the transfer bit counter 62 byte by byte. In this case, the CPU 1 retrieves the serial data which is output from the SOD terminal at the leading edge of the SCLK.

In a case where the R/W bit and the RS bit in the start byte are unnecessary to alter, a plurality of byte data can be transferred continuously. When the plurality of bytes in the display RAM 4 are rewritten collectively and continuously, the data in the display RAM 4 can be rewritten continuously without the start byte if the R/W bit is set to "0" and the RS bit to "1" initially in the start byte. Since the CPU address counter 6 for supplying the rewriting address in the display RAM 4 is automatically incremented each time one byte is then rewritten, it is unnecessary for the CPU 1 to sequentially reset the CPU address counter 6.

When R/W bit=0, RS bit=0, the CPU address counter 6 or the group of instruction registers 24 is selected as mentioned above and data is written thereto. In this case, the CPU address counter 6 and one of the registers in the group of instruction registers 24 may be selected by the following method.

Of the data of two bytes which follow the start byte above, specific bits are used as selection data. Then selection signals for selecting the CPU address counter 6 and one of the registers in the group of instruction registers 24 are formed by decoding the specific bits, using a decoder for selecting purposes. The data of two bytes (remaining bits) excluding the specific bits are used as setting data because the number of bits of such data to be set in the register of the group of instruction registers 24 may have not greater than eight bits. For this reason, the data of two bytes (remaining bits) excluding the specific bits can be used as setting data.

When R/W=0 and RS=1, the data of two bytes as they are can be used for writing since the RAM address is formed by the CPU address counter 6.

When R/W=1, data in the CPU address counter 6 or RAM should be read out according to the value of the RS.

The above embodiment of the present invention has the following effect:

(1) With the provision of the scroll display line designation register 15 and the scroll dot quantity register 16 for selectively carrying out scrolling from side to side in display lines, the line coincidence detection circuit 20 for detecting whether or not a display line being displayed is what should be scrolled, and the scroll shift register 11 for shifting a character pattern to be displayed in pixels, only a desired display line can be scrolled from side to side selectively in pixels.

(2) Thus a specific display line can be scrolled smoothly and effectively. In comparison with scrolling character pattern by character pattern, display quality is greatly improved.

(3) Further, the data in the display RAM 4 for storing character codes needs not rewriting when the scrolling is carried out and this contributes to simplifying software processing as the loads of the CPU 1 become reducible.

(4) When information of different nature is displayed line by line in a limited display space as in the case of small-sized apparatus such as pocket telephones, for example, only desired display linea can successively be scrolled so as to have their contents displayed. Thus the performance of displaying information or the quantity of information to be displayed as in small display apparatus can readily be augmented in response to the needs of data display in various future information services particularly using portable or mobile communications terminals; for example, in cases where weather forecasts and information on traffic jams are displayed sequentially on a specific display line.

(5) By controlling data transmission in bytes so as to reset the transfer bit counter 62 in synchronization with the detection of the synchronizing bit string synchronized with the serial transfer clock, the transfer procedure can be reset in response to the detection of the next synchronizing bit string even though the shifting of the data bits occurs with respect to the CPU 1.

(6) Even while the reading operation is performed by the CPU 1 via the output terminal SOD, the synchronizing bit string and the R/W bit which follows subsequently are monitored upon reception of the output of the input terminal SID, write/read switching is made achievable by using three of interface signals SCLK, SID and SOD.

(7) The adoption of the interfacing procedure makes feasible data transmission corresponding to a plurality of operating modes in synchronization with SCLK as a simple clock signal. In other words, no exclusive data transmission protocol using clock or timing signals having special waveforms is needed. Therefore, the CPU 1 for controlling the liquid crystal display control device 2 according to this embodiment of the invention is required to have an ordinary serial interface or a port. As a result, any CPU may be utilized extensively in a relatively wide range as a main control for the liquid crystal display control device.

Figure 11:
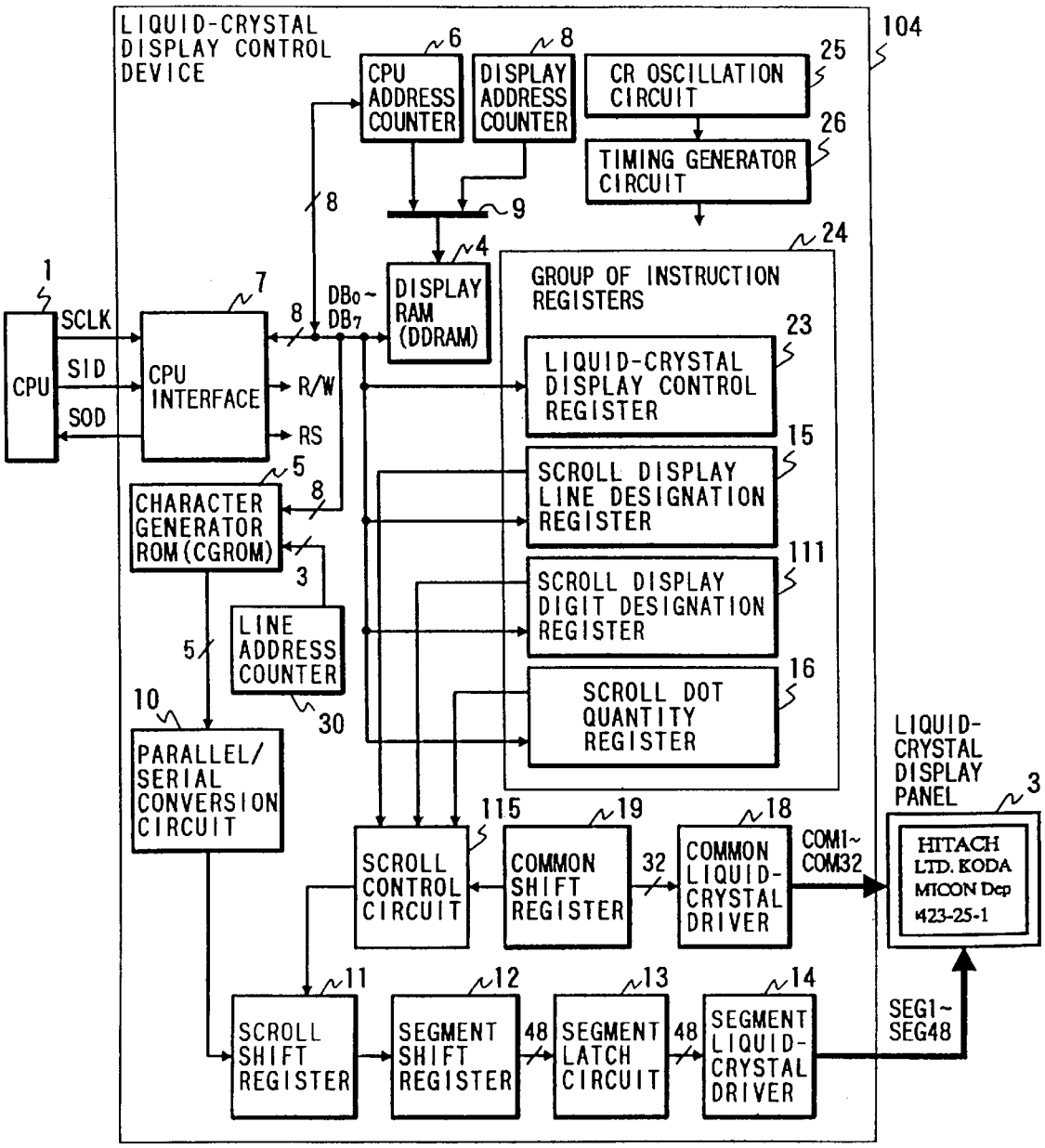
FIG. 11 is a block diagram of a second embodiment of the liquid crystal display control device of the present invention.

FIG. 11 shows a system configuration using liquid crystal display control device 104 as a second embodiment of the present invention. Like reference characters are given to circuit blocks having functions similar to those illustrated in FIG. 1 and a detailed description thereof will be omitted. In reference to the embodiment described in FIG. 1, a scroll display digit designation register 111 is added to the group of instruction registers 24. A value is set in this scroll display digit designation register 111 via the CPU interface 7. In other words, position data on display digits to be scrolled is written to the scroll display digit designation register 111. Of the display lines designated by the scroll display line designation register 15, control is exerted over the scrolling of the pixels designated by the scroll dot quantity register 16 with respect to the display digits designated by the scroll display digit designation register 111. The scrolling is controlled by the group of instruction registers 24, a scroll control circuit 115 and the scroll shift register 11.

Figure 12:
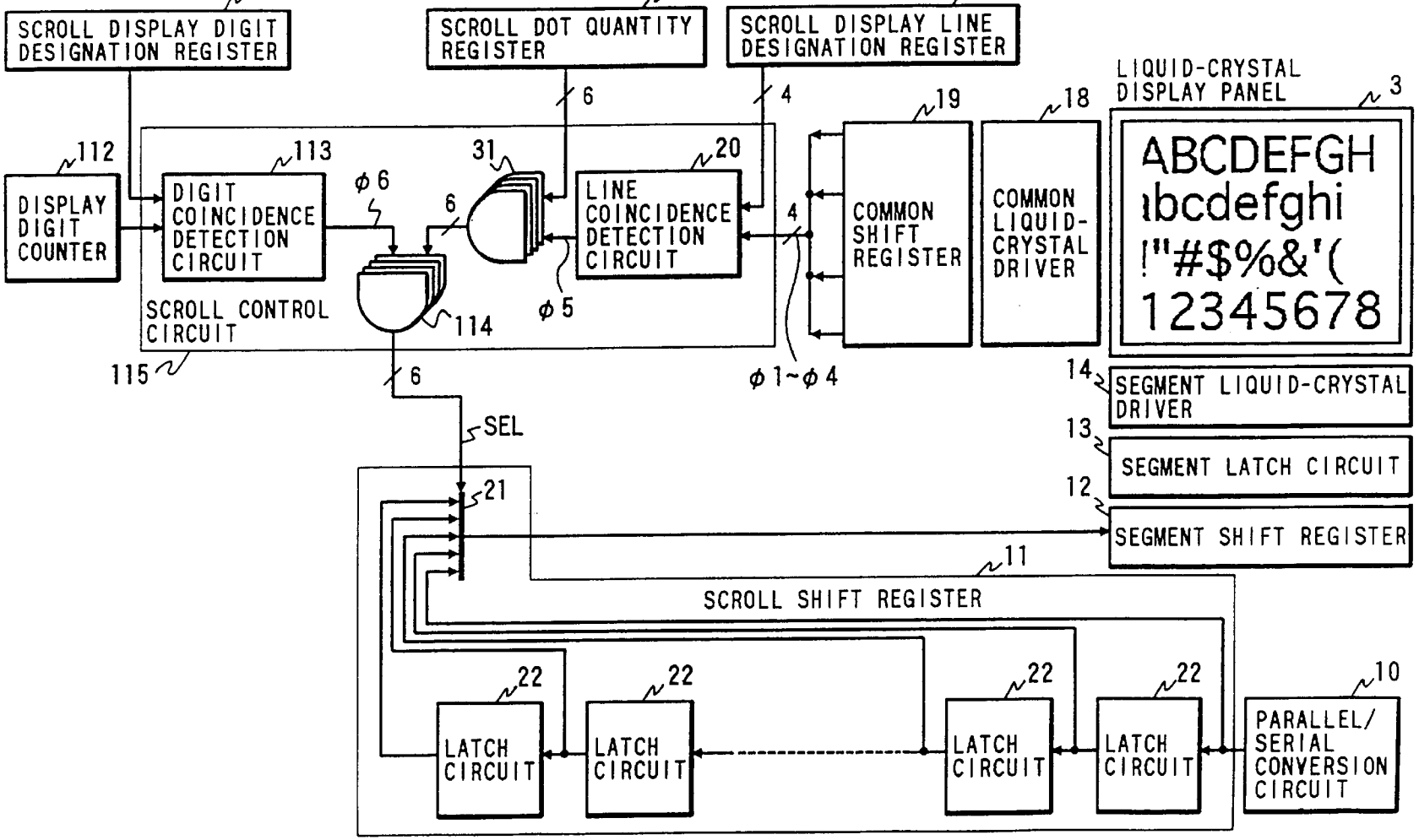
FIG. 12 is a diagram illustrating an exemplary scroll control circuit in detail.

FIG. 12 is a detailed circuit diagram for scrolling. The second embodiment refers to a case where, by way of example, vertical four lines and horizontal eight digits of a character font pattern constituted by 6×8 dots are displayed, not exclusively. The common liquid crystal driver 18 has 32 drive circuits in total when four digits are displayed as each display character line comes up to eight lines. As eight digits are displayed at 6-dot intervals, moreover, the segment liquid crystal driver 14 has 48 drive circuits.

Figure 13:
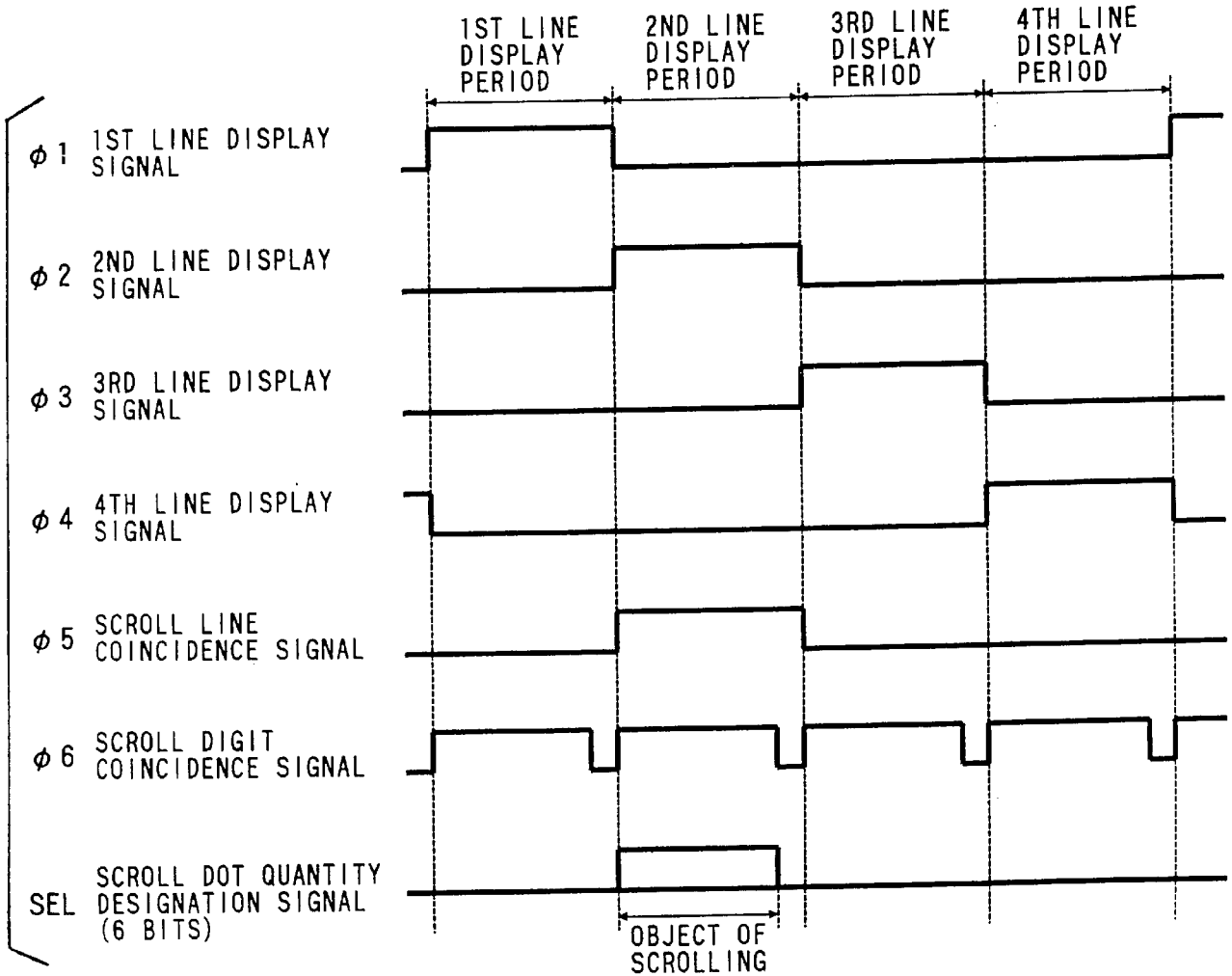
FIG. 13 is a timing chart showing exemplary timing of generating a display line signal, a scroll display line designation signal, a scroll display digit designation signal and the like in the scroll control circuit of FIG. 12.
Figure 14A:
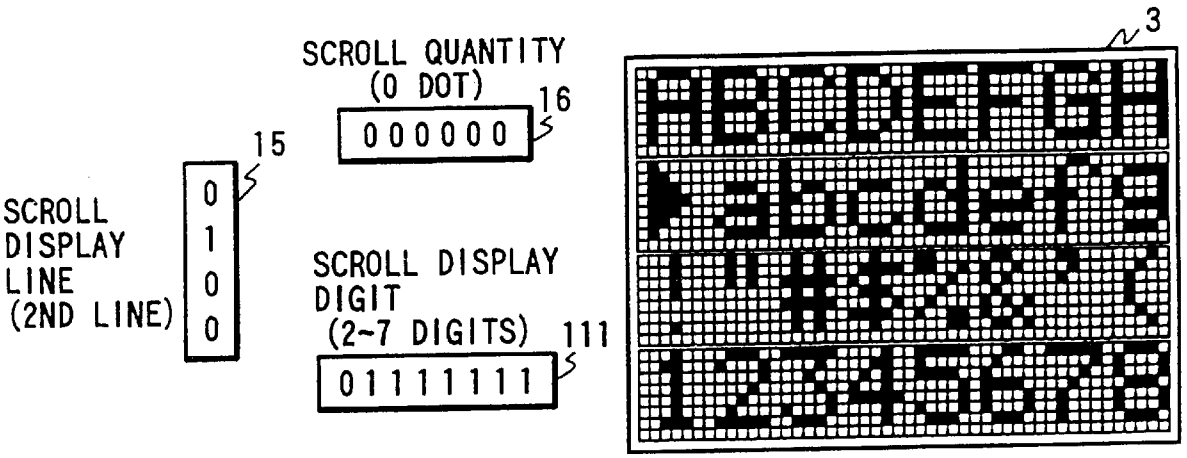
FIGS. 14(A) and 14(B) are diagrams illustrating the first-half exemplary operations of selectively scrolling the designated display lines and digits.
Figure 14B:
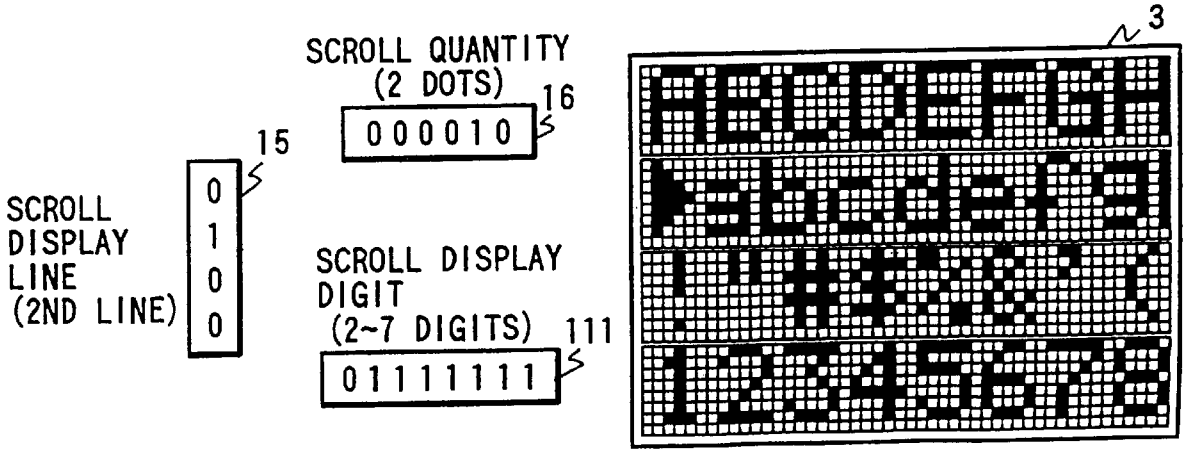
Figure 15A:
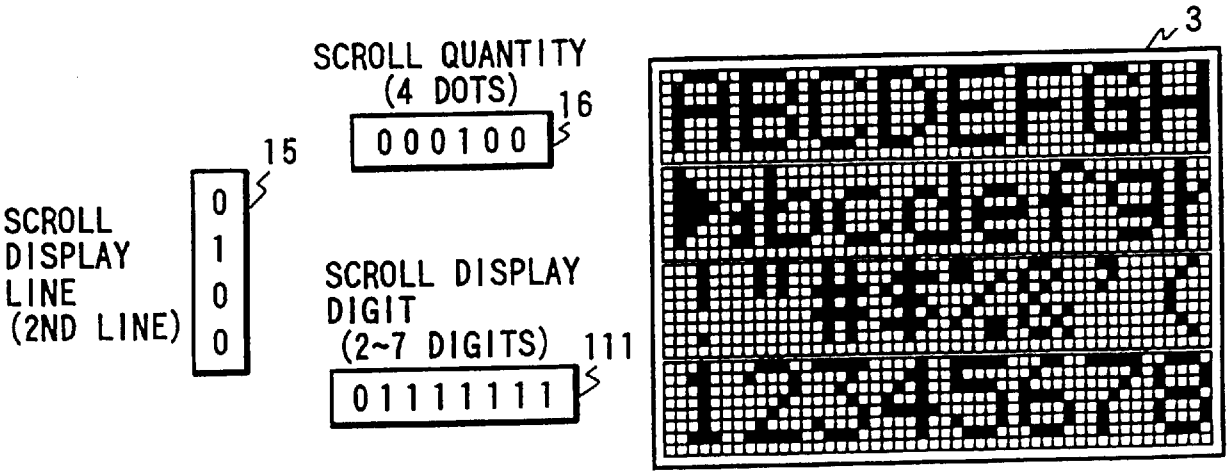
FIGS. 15(A) and 15(B) are diagrams illustrating the second-half exemplary operations following FIGS. 14(A) and 14(B).
Figure 15B:
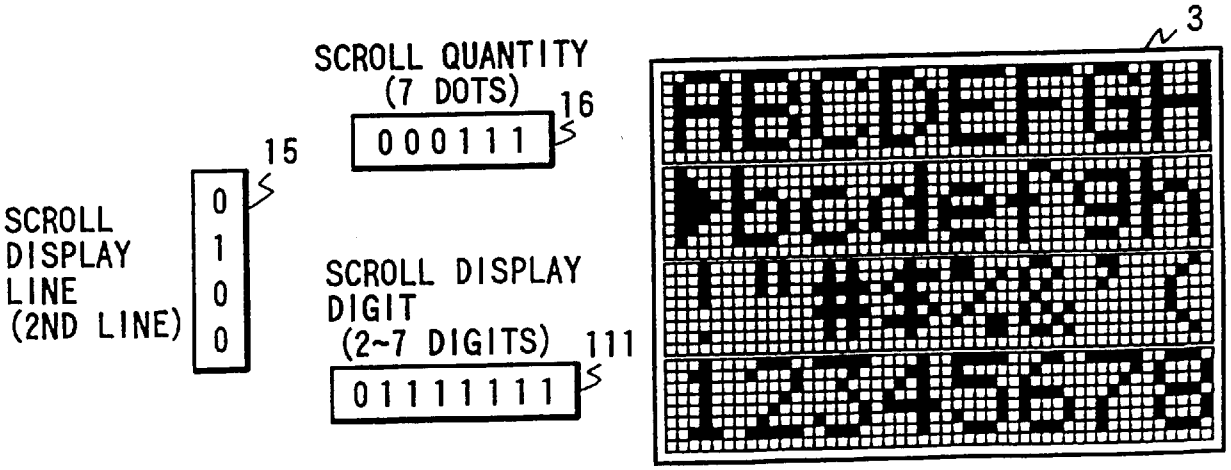

In FIG. 12, the line coincidence detection circuit 20 as in the embodiment of FIG. 2 compares a display line being driven with the 4-bit data set in the scroll display line designation register 15 and when the results of comparison coincide, a scroll line coincidence signal ϕ5 is set at a high level during the period as shown in FIG. 13. A digit coincidence detection circuit 113 compares a display digit counter 112 which is performing the display operation with 8-bit data set in the scroll display digit designation register 111 and when the results of comparison coincide, a scroll line coincidence signal ϕ6 is set at a high level during the period as shown in FIG. 13. The display digit counter 112 is what is decremented in characters line by line. The gate circuit 31 outputs a scroll dot quantity of six bits as designated by the scroll dot quantity register 16 during the line display period of scrolling. A gate circuit 114 outputs a scroll dot quantity of six bits only during the line display period of scrolling and supplies the quantity thereof to the scroll shift register 11. While the scroll line coincidence signal ϕ5 or the scroll digit coincidence signal ϕ6 remains at a low level, the gate circuit 31 or the gate circuit 114 lets all six bits of the scroll dot quantity designation signal SEL have a logical value of 0 by masking and supplies the signal SEL to the scroll shift register 11. Therefore, the scroll dot quantity designation data stored in the scroll dot quantity register 16 is supplied to the scroll shift register 11 only when the line displayed on the panel 3 agrees with the scroll line designated by the register 15 and besides with the scroll line designated by the register 111.

FIG. 13 shows an example of generating the timing above. While the first to fourth lines are driven in time-sharing, ϕ1 to ϕ4 are set at the high level, respectively. Whereas ϕ5 is set at the high level during only the period that the display line designated by the scroll display line designation register 15 to be scrolled is being driven. Moreover, ϕ6 is set at the high level during only the period that the display digit designated by the scroll display digit designation register 111 to be scrolled is being driven. The scroll dot quantity designation signal SEL outputs the scroll quantity stored in the scroll dot quantity register 16 during the scroll period and is set at a logical value of 0 during any other period.

FIGS. 14(A), 14(B) and FIGS. 15(A), 15(B) successively show examples of scrolling part of a display digit. The scrolling of the second line on the panel 3 is designated by the scroll display line designation register 15 and that of the second to eighth digits is designated by the scroll display digit designation register 111. As shown in FIGS. 14(A), 14(B) and FIGS. 15(A), 15(B), the scroll dot quantity is then increased in due order, whereby seven characters from the second to eighth digits on the second line of the panel 3 are scrolled and displayed in accordance with the scroll quantity designated by the scroll dot quantity register 16.

Although the scroll display line designation register 15 can be set in display lines, scrolling is not necessarily restricted by the setting of the scroll display digit designation register 111 in display digits. A scroll display digit register in 1-bit configuration is formed, for example, so that the scrolling of digits other than one digit at the leftmost end of the panel 3 can be designated. In this case, those not smaller than second digit on the panel 3 are scrolled and displayed when the bits of the respective digits are "1" and one digit at the leftmost end is fixedly displayed without being scrolled. When the bit involved is "0", all the display digits may be scrolled and displayed.

Figure 16:
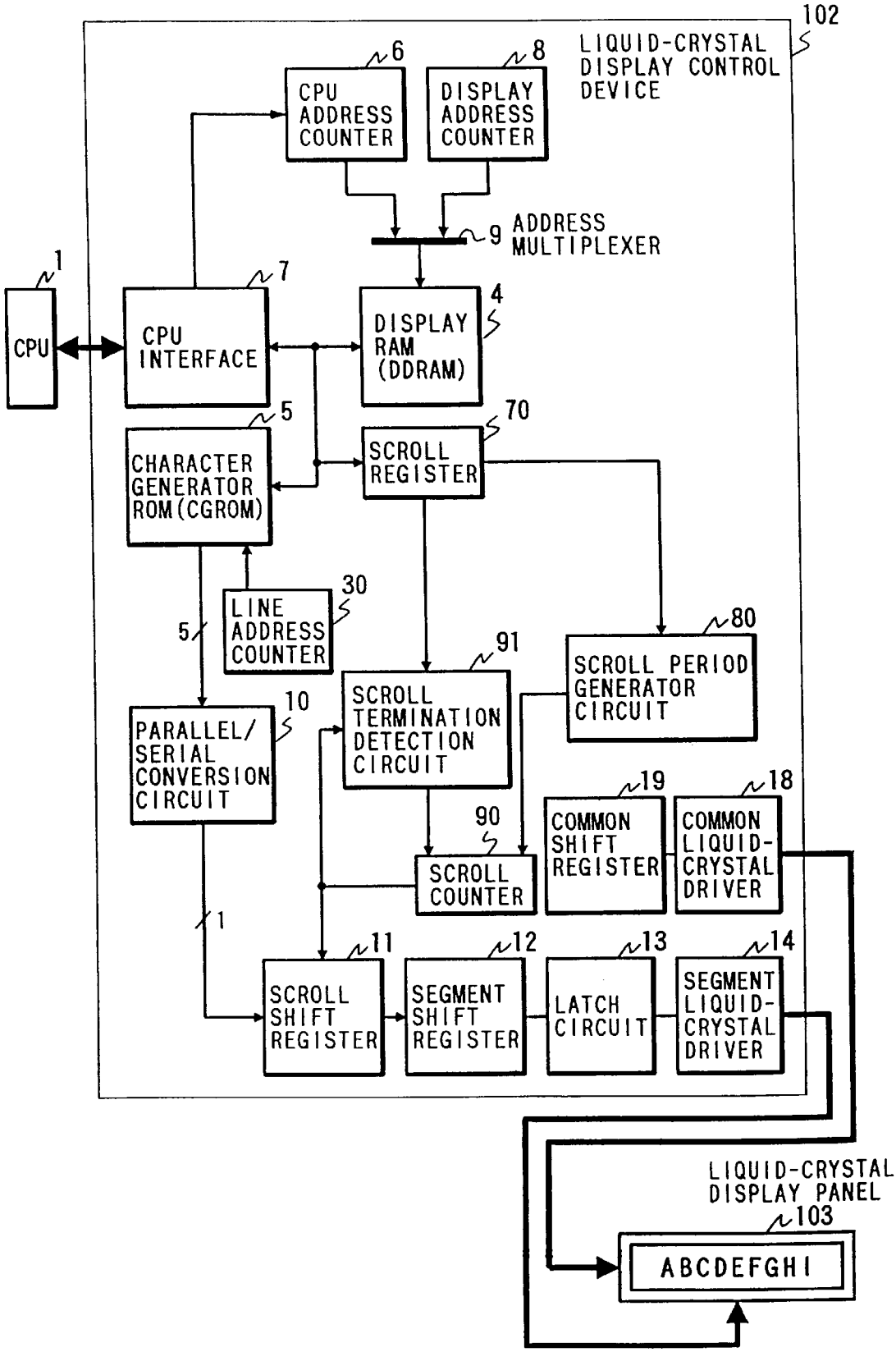
FIG. 16 is a block diagram of a system configuration employing a third embodiment of the liquid crystal display control device of the present invention.

FIG. 16 shows a system configuration using liquid crystal display control device 102 as a third embodiment of the present invention. Like reference characters are given to circuit blocks having functions similar to those illustrated in FIG. 1 and a detailed description thereof will be omitted. A liquid crystal display panel 103 displays a font of 5×8 dots with maximum 12 digits·1 line, not exclusively, and has eight common electrodes and 60 segment electrodes. As in the embodiment of FIG. 1, the CPU 1 writes to the display RAM 4 the character codes of characters to be displayed on the liquid crystal display panel 103. The character codes thus written are sequentially output from the display RAM 4 from the 20th digit to the first digit in accordance with the operation of incrementing the display address counter 8. The character code that has been output together with the output of the line address counter 30 is made the address data of the character generator ROM 5, whereby font data is output from the character generator ROM 5 in five bits. The font data in five bits is converted by the parallel/serial conversion circuit 10 to serial data, which is supplied to the segment liquid crystal driver 14 via the scroll shift register 11 and the segment shift register 12.

In order to achieve the smooth scrolling according to this embodiment of the invention, there are provided, in place of the scroll control circuit 17 and the group of instruction registers 24 of FIG. 1, a scroll register 70 for storing scroll control data, a scroll cycle generating circuit 80 for generating scroll cycles for carrying out scrolling in dots (pixels), a scroll counter 90 for counting the scroll quantity, and a scroll termination detection circuit 91 for detecting scroll termination. The CPU 1 is required only to choose initial setting for the scroll register 70 when carrying out smooth scrolling so as to lighten the load applied to the CPU 1. The initial setting of the scroll register 70 is fulfilled by CPU 1 via the CPU interface 7.

Figure 17:
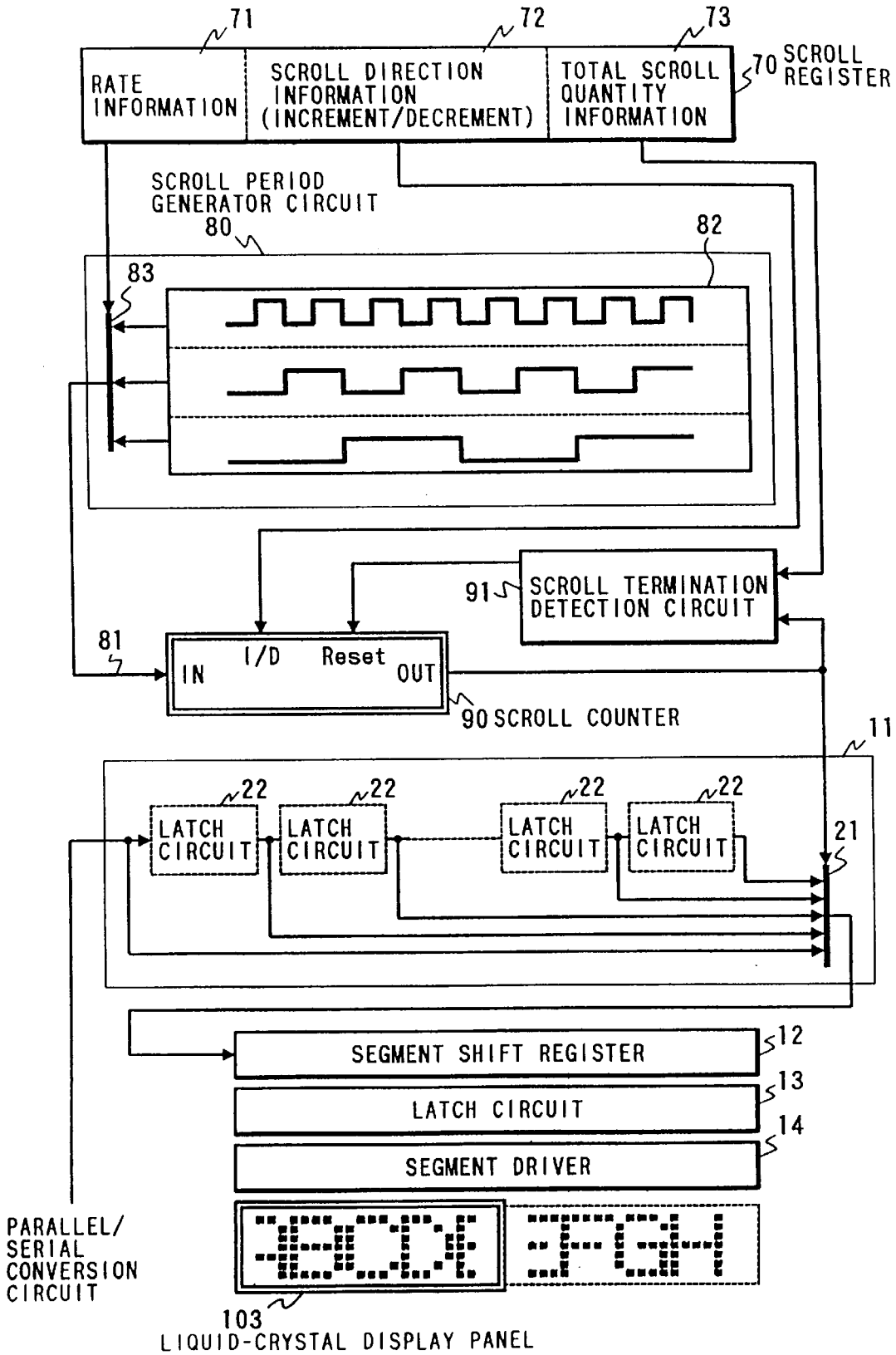
FIG. 17 is a detailed block diagram of a scroll arrangement in the embodiment of FIG. 16.

FIG. 17 is a detailed block diagram of an arrangement for carrying out scrolling in this embodiment of the invention. The scroll cycle generating circuit 80 generates a scroll cycle signal 81 for providing the time interval of the scroll operation, that is, a scroll rate. In this embodiment of the invention, the scroll cycle signal 81 is a clock signal and what has a predetermined cycle is output by causing a multiplexer 83 to select the output of a counter circuit or a clock pulse generator 82 for generating clock signals having different cycles. The cycle of the scroll cycle signal 81 may be determined relative to the reaction rate of liquid crystal and a plurality of cycles that can be selected are said to range from several 10 msec up to several 100 msec, for example. The selection above is made by supplying scroll rate data (first data) 71 stored in the scroll register 70 to the multiplexer 83.

The scroll counter 90 receives the scroll cycle signal 81 at its clock input terminal IN, counts rise transitions, and supplies to the scroll shift register 11 the count from its output terminal OUT as scroll dot quantity. As in the case of FIG. 1, the scroll shift register 11 selects the output of the latch circuit 22 of the following stage as the scroll dot quantity increases and supplies the output thereof to the segment shift register 12. In the scroll counter 90, I/D represents a terminal to which a counting direction is given, that is, an instruction as to the increment or decrement operation is given. According to this embodiment of the invention, the counting direction in the scroll counter 90 is designated by the scroll direction data (second data) 72 stored in the scroll register 70.

When all counting bits are output as counts from the scroll counter 90, the output value of the scroll counter 90 is incremented or decremented by 1 each time the scroll cycle signal 81 is changed. Therefore, one dot is scrolled per cycle of the scroll cycle signal 81. When two dots are scrolled per cycle of the scroll cycle signal 81, it is only needed to add a dummy bit of "0" to the least significant bit output from the scroll counter 90, the resulting output being supplied to the multiplexer 21 then.

Reset is the reset terminal of the scroll counter 90. In the reset state of the scroll counter 90, its output is, not exclusively, initialized so that the whole bit is "0". The reset state is such that the scroll dot quantity is reduced to "0". In this embodiment of the invention, total scroll quantity data (third data) is stored in the scroll register 70 and supplied to the scroll termination detection circuit 91. The scroll termination detection circuit 91 detects the coincidence between the output of the scroll counter 90 and total scroll quantity data 73 and resets the scroll counter 90 to terminate a series of scroll operations.

A description will subsequently be given of a third embodiment. In this description of the function, one dot is to be scrolled per cycle of the scroll cycle signal 81. When the display line is scrolled, the CPU 1 operates to set scroll data including the total scroll quantity data (the number of dots) 73, the scroll direction data 72 and the scroll rate data 71 in the scroll register 70. The scroll register 70 performs the increment or decrement operation to advance the scroll quantity dot by dot per cycle of the selected scroll cycle signal 81 and supplies the resulting count to the scroll shift register 11. The scroll shift register 11 selects the output of the latch circuit of the following stage each time the count is increased and selects the output of the latch circuit of the preceding stage each time the count is decreased. While manipulating the transfer skew quantity (delay quantity), the scroll shift register 11 causes the display line to be scrolled dot by dot. When the output of the scroll counter 90 agrees with the total scroll quantity, the scroll counter 90 is reset at that point of time and smooth scrolling is terminated. With this arrangement, scrolling to the right should be understood to be utilized for the process of moving the display scrolled to the left back to the right once. In such a case as this, the CPU 1 is only to set an instruction again as to scrolling the contents of the scroll shift register 71 to the right in the course of scrolling to the left.

Figure 18A:
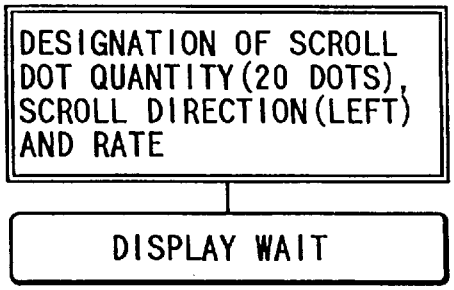
FIGS. 18(A) and 18(B) are flowcharts for comparing the loads applied to CPUs in the embodiments of FIGS. 1 and 6.
Figure 18B:
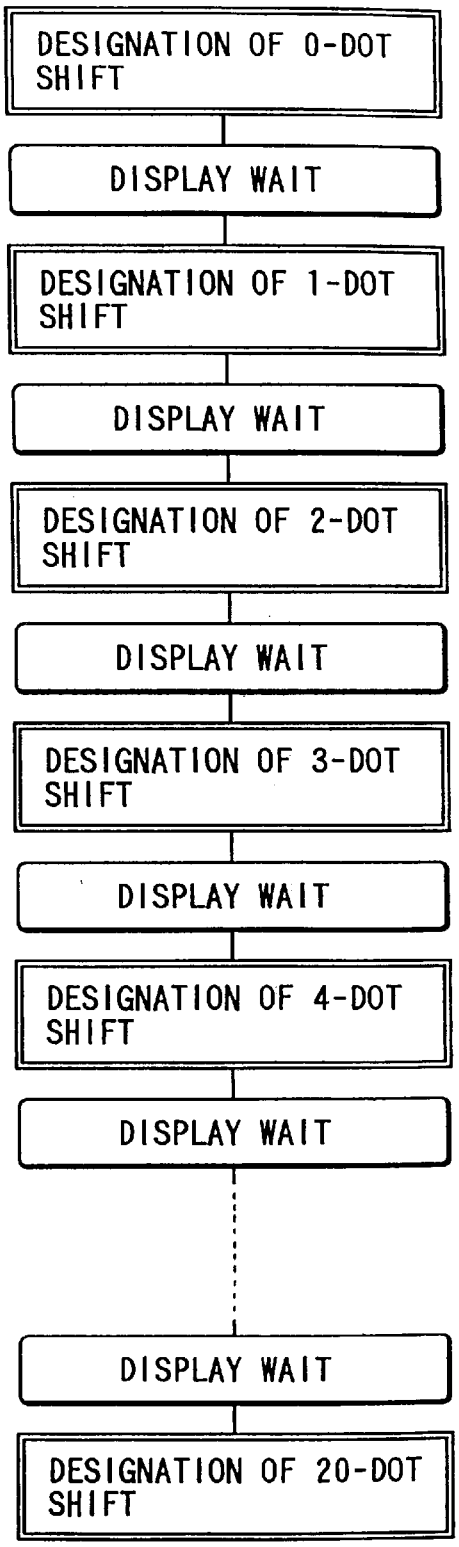

When scrolling, for example, 20 dots to the left is horizontally carried out, the CPU 1 is only to write the scroll data including the total scroll quantity data 73, the scroll direction data 72 and the scroll rate data 71 to the scroll register 70 as shown in FIG. 18(A). According to the data written to the scroll register 70 and the count cycle of the scroll cycle generating circuit 80, the scroll counter 90 sequentially increments the scroll quantity from "0" dot up to 20th dot, whereas the scrolling from "0" dot up to 20th dot is automatically processed by the scroll shift register 11. When the scroll termination detection circuit 91 detects that the scroll counter 90 has counted 20 dots, it causes the scroll counter 90 to stop the increment operation. Until the suspension of the increment operation, the CPU 1 is not required to effect any display control but just kept waiting (display wait). In the case of the embodiment described by reference to FIG. 1, on the other hand, the CPU 1 has to issue to the liquid crystal display control device the display scroll instruction as to rewriting the scroll dot quantity register 16 each time one dot is scrolled and to execute the instruction (see FIG. 18(B)). Consequently, the CPU 1 has to repeat the execution of such instruction 20 times in total and also has to control interval time to equalize instruction issuing or executing intervals in order to make the scrolling appear smooth.

With the liquid crystal display control device 102 in this embodiment of the invention, the scroll operation is autonomously controllable independent of the CPU 1 after the scroll instruction is issued once and scroll executing time control can be dispensed with. Therefore, the load applied to the CPU 1 and accompanied with the smooth scrolling becomes considerably reducible as compared with the embodiment of FIG. 1. Notwithstanding, the scroll mode adoptable in the embodiment of FIG. 1 has freedom greater than what is allowed in this embodiment since any scroll dot quantity can be set in the register 16 in the former.

A detailed description has been given of the invention made by the present inventors with reference to the its embodiment. However, the present invention is not limited to those embodiments but may needless to say be modified in various manners without departing from the spirit and scope of the invention.

Although a description has been given of a representative case where a single display line is scrolled in the embodiment of FIG. 17, for example, the present invention is applicable to a case where any desired line selected from among a plurality of display lines can be scrolled. For example, the output of the scroll counter 90 of FIG. 17 is supplied via the gate circuit 31 described in the embodiment of FIG. 2 to the multiplexer 21 so as to control the gate circuit by means of the line coincidence detection circuit 20 of FIG. 2 likewise. In this case, it is only needed to provide the scroll register 71 with an area for use in storing scroll display line data to be supplied to the line coincidence detection circuit 20.

In the above-described embodiments of the invention, the display address counter 8 is decremented and the pixel data row is input from the left side of the segment shift register 12 in synchronization therewith. In addition, the scrolling is carried out to the left as the scroll quantity is gradually increased, whereas it is carried out to the right as the scroll quantity is gradually decreased. Conversely, it may also be arranged that the display address counter 8 is decremented and the pixel data row is input from the right side of the segment shift register 12 in synchronization therewith and that the scrolling is carried out to the right as the scroll quantity is gradually increased, whereas it is carried out to the left as the scroll quantity is gradually decreased.

Moreover, the scroll display line may be fixed or otherwise the provision of the scroll display line control means may be omitted.

The number of pixels forming a font, the display size of the liquid crystal display panel, the storage capacity of the display RAM and the like may be altered properly without being restricted to the embodiments above. Although the scroll shift register 11 has been employed in the embodiments above so as to shift the timing of supplying the pixel data row to the drive circuit on a pixel data basis, it may also be an exemplary arrangement to lead the parallel outputs of the latch circuits to the multiplexer 21 at intervals of several stages.

Further, the present invention is applicable to making display in a specific window on a display apparatus.

Each of the liquid crystal display control devices 2 (FIG. 1), 104 (FIG. 11) and 102 (FIG. 16) is formed on one semiconductor substrate, though not exclusively, by any known semiconductor technology. With respect to the display RAM (DDRAM) and/or the character generator ROM (CGROM), what is formed on any other semiconductor substrate may be utilized without being restricted to the above embodiments of the present invention. In this way, attempts to increase the display quantity and/or kinds of display patterns may be implemented.

In the embodiment of FIG. 1, it has been arranged to provide the liquid crystal display control device (liquid crystal display control LSI) formed on one semiconductor substrate with the external clock terminal for receiving the serial clock SCLK, the external data terminal for receiving the serial data SID, and the external data terminal for outputting the serial data SOD. In addition, the external terminal for outputting the segment signals SEG 1–SEG 60 and the external terminal for outputting the common signals COM 1–COM 32 are provided. However, these external terminals may be used simultaneously for other signals.

Although a description has been given of the application of the present invention made by the present inventors to liquid crystal display technology as the background thereof, the present invention is not limited to the embodiments set forth above but may be applied to driving and controlling fluorescent tube display, plasma display and the like in many other display apparatus.

The effect achievable by the representative embodiments of the present invention is as follows:

With the adoption of the scroll quantity control means for shifting the timing of supplying the pixel data row for use in driving the signal electrode by a predetermined quantity on a pixel data basis, smooth scrolling in pixels can be achieved by gradually increasing or decreasing the quantity to be shifted.

With the adoption of the scroll display line control means, any desired display line can be scrolled smoothly.

With the adoption of the scroll display digit control means, any desired display digit can be scrolled smoothly.

By making it possible to designate the shift quantity like scroll dot quantity and the scroll display line in the storage means, the freedom of designating any scroll mode can considerably be improved.

The data stored in the display RAM for storing character codes needs no rewriting when the smooth scrolling is carried out, whereby the load applied to the CPU becomes reducible, thus simplifying software processing. Moreover, the load applied to the CPU is further reduced as compared with display control of a bit map type as no sequential rewriting is required for a large-capacity memory like a bit map memory and therefore smooth scrolling is achievable.

Further, with the adoption of the scroll quantity control means for updating the scroll rate and the scroll dot quantity autonomously and sequentially, the load applied to the CPU becomes considerably reducible.

With the adoption of the interface means for controlling data transmission by resetting the transfer control counter in synchronization with the synchronizing bit row synchronized with the serial clock signal, and monitoring the synchronizing bit string and the access control data which follows subsequently on receiving the input of the serial input terminal even during the read operation from the serial data output terminal, interfacing with the CPU such as a data processor or a microcomputer may be carried out simply with the serial clock, whereby the interfacing with the CPU such as a data processor or a microcomputer can be carried out simply with the serial clock. Thus a display control device which will not restrict CPU utilizable as an independent control can be created.

What is claimed is:

1. A display system for controlling an operatively associated display device which includes a plurality of scanning electrodes, a plurality of sianal electrodes, and a plurality of display elements at intersections between the plurality of scanning electrodes and the plurality of signal electrodes to display a pattern on the display device, the display system comprising:

a processor adapted to generate a serial transfer clock signal and a serial data signal, the serial data signal being generated in synchronization with the serial transfer clock signal; and, a display control circuit having a first external terminal coupled to the processor and a second external terminal coupled to the processor, the first external terminal being adapted to receive the serial transfer clock signal into the display control circuit and the second external terminal being adapted to receive the serial data into the display control circuit, the display control circuit further comprising:

a first driving circuit selectively driving the plurality of scanning electrodes of the associated display device in a time-sharing manner;

a second driving circuit selectively driving the plurality of signal electrodes of the associated display device to generate a pattern on the display device in accordance with pixel data;

a first memory adapted to store code data, the code data being representative of characters to be displayed on the operatively associated display device;

a second memory adapted to store said pixel data and being operative to selectively output first pixel data for use by said second driving circuit to generate, on the associated display device, a first display pattern corresponding to first code data read from the first memory;

an address circuit designating an address of the first memory; and, a first conversion circuit operatively coupled to the first and the second external terminals and being adapted to convert the serial data received at the second external terminal to parallel data in synchronization with the serial transfer clock signal and to selectively write the parallel data into the first memory at an address of the first memory designated by the address circuit to thereby store the parallel data converted from said serial data as said code data in the first memory.

2. A display system according to claim 1, wherein the first conversion circuit includes:

a serial storage circuit coupled to the first and the second external terminals, the serial storage circuit including a plurality of latch circuits each connected, respectively, in series; and, a parallel data latch circuit having inputs which are coupled to outputs of the latch circuits in the serial storage circuit, respectively, and a plurality of outputs which are coupled to inputs of the first memory, respectively.

3. A display system according to claim 2, wherein the display control circuit includes a second conversion circuit adapted to convert parallel data provided from the first memory to serial data in synchronization with the serial transfer clock signal.

4. A display system according to claim 3, wherein the first conversion circuit, the second conversion circuit, the address circuit, the first memory and the write circuit are disposed on one semiconductor substrate.

5. A display system according to claim 4, wherein the display control circuit further comprising a third external terminal receiving the serial data generating from the second converting circuit.

6. A display svstem according to claim 5, wherein the display control circuit further comprises:

an access circuit accessing the first memory, and a pattern forming circuit converting the data accessed by the access circuit from the first memory to a pattern to be displayed on the display device.

7. A display system comprising:

a microprocessor (CPU) adapted to generate a serial clock signal and serial data in synchronization with the serial clock signal, the serial data including first control data and code data; and, a display control device adapted to control an operatively associated display device to display a pattern having a plurality of pixels on a set of display elements arranged at intersections of scanning electrodes and signal electrodes in a dot matrix form, the display control device comprising:

a first drive circuit sequentially driving the scanning electrodes;

a second drive circuit driving the signal electrodes in accordance with pixel data;

a display memory storing code data;

a pattern data memory for outputting said pixel data based on code data read from the display memory;

a serial clock input terminal coupled to the microprocessor, the serial clock input terminal being adapted to receive the serial clock signal from the microprocessor;

a serial data input terminal coupled to the microprocessor, the serial data input terminal being adapted to receive the serial data from the microprocessor as said code data to be stored in said display memory;

a serial storage circuit coupled to the serial data input terminal and the serial clock input terminal, the serial storage circuit including a plurality of latch circuits adapted to latch the serial data sequentially in synchronization with the serial clock signal;

a parallel data latch circuit having inputs coupled to output nodes of respective ones of the plurality of latch circuits in the serial storage circuit and outputs coupled to data inputs of the display memory;

a counter coupled to receive the serial clock signal and adapted to toll counts of the serial clock signal and selectively generate a latch timing signal to the parallel data latch circuit according to the count thereof to enable the parallel data latch circuit to latch data into the latch circuits in the serial storage circuit; and, an access control latch circuit adapted to fetch said first control data stored in ones of the latch circuit into the serial storage circuit and adapted to control a writing of the latched code data stored in the parallel data latch circuit into said display memory.

8. A display system according to claim 7, wherein:

the display control circuit further includes a parallel/serial conversion circuit having inputs selectively coupled to data outputs of the display memory and having an output for outputting serial data, the parallel/serial conversion circuit generating a serial output synchronized with the serial clock signal; and, said counter is adapted to generate a control signal for controlling an output start timing of the parallel/serial conversion circuit according to the count thereof.

9. A display system according to claim 8, wherein the display control circuit further includes:

a serial data output terminal coupled to the output of the parallel/serial conversion circuit.

10. A display system according to claim 7, wherein the display control circuit further includes:

a control register adapted to store an instruction controlling operation of the display control circuit; and, an address counter adapted to provide an address signal for the display memory during the writing of latched code data from the parallel data latch circuit to the display memory, wherein the serial data further includes second control data to be stored in the register or the address counter, and wherein the access control latch circuit is adapted to provide a selection signal for selecting a one of the register, the address counter, and the display memory in accordance with the fetched first control data so that a one of the second control data and the code data included in the serial data is written into a one of the register, the address counter, and the display memory.

11. A display control circuit for use with an operatively associated microprocessor and a display device to control the display of a pattern on the display device, the processor being adapted to generate a serial transfer clock signal and a serial data signal in synchronization with the serial transfer clock signal, and the display device including a plurality of scanning electrodes, a plurality of signal electrodes, and a plurality of display elements at intersections between the plurality of scanning electrodes and the plurality of signal electrodes, the display control circuit comprising:

a first external terminal coupled to the microprocessor and a second external terminal coupled to the microprocessor, the first external terminal being adapted to receive the serial transfer clock signal into the display control circuit and the second external terminal being adapted to receive the serial data into the display control circuit;

a first driving circuit adapted to selectively drive the plurality of scanning electrodes of the associated display device in a time-sharing manner;

a second driving circuit adapted to selectively drive the plurality of signal electrodes of the associated display device to generate a pattern on the display device in accordance with pixel data;

a first memory adapted to store code data, the code data being representative of characters to be displayed on the operatively associated display device;

a second memory adapted to store said pixel data and being operative to selectively output first pixel data for use by said second driving circuit to generate, on the associated display device, a first display pattern corresponding to first code data read from the first memory;

an address circuit designating an address of the first memory; and, a first conversion circuit operatively coupled to the first and the second external terminals and being adapted to convert the serial data received at the second external terminal to parallel data in synchronization with the serial transfer clock signal and to selectively write the parallel data into the first memory at an address of the first memory designated by the address circuit to thereby store the parallel data converted from said serial data as said code data in the first memory.

12. The display control device according to claim 11, wherein the first conversion circuit includes:

a serial storage circuit coupled to the first and the second external terminals, the serial storage circuit including a plurality of latch circuits each connected, respectively, in series; and, a parallel data latch circuit having inputs coupled to outputs of the latch circuits in the serial storage circuit, respectively, and a plurality of outputs which are coupled to inputs of the first memory, respectively.

13. The display control device according to claim 12 further comprising a second conversion circuit adapted to convert parallel data provided from the first memory to serial data in synchronization with the serial transfer clock signal.

14. The display control device according to claim 13, wherein the first conversion circuit, the second conversion circuit, the address circuit, the first memory and the write circuit are disposed on one semiconductor substrate.

15. The display control device according to claim 14 further comprising a third external terminal receiving the serial data generating from the second converting circuit.

16. The display control device according to claim 15 further comprising:

an access circuit accessing the first memory; and, a pattern forming circuit converting the data accessed by the access circuit from the first memory to a pattern to be displayed on the display device.

* * * * *